US008646283B2

(12) United States Patent
Kuratani et al.

(10) Patent No.: US 8,646,283 B2
(45) Date of Patent: Feb. 11, 2014

(54) ICE MAKING METHOD AND ICE MAKING DEVICE

(75) Inventors: Hiroki Kuratani, Nagano (JP); Katsuhiko Hayashi, Nagano (JP); Shigeru Ozawa, Nagano (JP)

(73) Assignee: Nidec Sankyo Corporation (JP)

( * ) Notice: Subject to any disclaimer, the term of this patent is extended or adjusted under 35 U.S.C. 154(b) by 260 days.

(21) Appl. No.: 13/016,024

(22) Filed: Jan. 28, 2011

(65) Prior Publication Data

US 2011/0192175 A1 Aug. 11, 2011

(30) Foreign Application Priority Data

Jan. 29, 2010 (JP) ..... 2010-017731

(51) Int. Cl.
*F25C 5/06* (2006.01)
*F25C 5/08* (2006.01)

(52) U.S. Cl.
USPC ..... 62/72; 62/344

(58) Field of Classification Search
USPC ..... 62/71, 345, 347, 349, 353, 400
See application file for complete search history.

(56) References Cited

U.S. PATENT DOCUMENTS 6,044,658 A * 4/2000 Ryu ..... 62/353
6,481,235 B2 * 11/2002 Kwon ..... 62/353

FOREIGN PATENT DOCUMENTS

JP 08054164 A * 2/1996
JP 10-47824 A 2/1998
JP 2004-301490 A 10/2004

OTHER PUBLICATIONS

AIPN English translation of JP 08-054164.*

* cited by examiner

*Primary Examiner* — John Pettitt
*Assistant Examiner* — Tareq M Alosh
(74) *Attorney, Agent, or Firm* — Cantor Colburn LLP

(57) ABSTRACT

An ice making method and device may include an ice making member inserting step in which an ice making member is inserted into water that is stored in an ice tray, an ice pieces making step in which the ice making member is cooled so that the water is frozen to form an ice pieces, an ice making member heating step in which the ice making member is heated so that a portion of the ice pieces sticking to the ice making member is melted, an ice making member drawing-out step in which the ice making member is drawn out from the ice pieces, and an ice pieces separating step in which the ice tray is deformed to separate the ice pieces from the ice tray. The ice pieces separating step and the ice pieces storing step are performed at positions under the ice making member.

9 Claims, 12 Drawing Sheets

6
5,5A
54
56
47a
47
74
74c
72
47b
47c
46c 6
5,5B
47a
54
56
74
74c
72
47b
47c
46c 6
51a
5
54
56
74
74c
72
47b
47c
46c 6
51a
47b
54
5
56
74
74c
72
47c
46c 6
51a
54
74
74c
72
5
56
55
46c
47c 6
51a
54
5,5C
74
74c
72
56
55
46c
47c
2
2
2

2
5
5,5A
5,5B
5,5C
6
8
9
47
47a
47b
51a
52b
54
56
72
74
74c
91
92

6
5,5A
54
47'
74c'
74'
72
103a
105
10

6
5,5B
47'
54
52b
74c'
74'
72
103a
105
10

6
5,5C
47'
51a
54
74c'
52b
74'
72
103a
105

6
51a
47'
54
105
74c'
74'
72
5
103a
52b
10
2

6
51a
47'
74c'
52b
10
103a
74'
72
2

6
47'
10
52b
103a
74c'
5
51a
74'
72
2

ICE MAKING METHOD AND ICE MAKING DEVICE

CROSS REFERENCE TO RELATED APPLICATION

The present invention claims priority under 35 U.S.C. §119 to Japanese Application No. 2010-17731 filed Jan. 29, 2010, the entire content of which is incorporated herein by reference.

FIELD OF THE INVENTION

At least an embodiment of the present invention may relate to an ice making method in which an ice making member such as an evaporation pipe is inserted into an ice tray that stores water to manufacture ice pieces. More specifically, at least an embodiment of the present invention may relate to an ice making method and/or an ice making device in which water within an ice tray is capable of being completely frozen when ice pieces are to be manufactured.

BACKGROUND

In an ice making device in which an ice making member such as evaporation pipe is inserted into an ice tray that stores water to manufacture ice pieces, the ice making member in a cooled state is inserted into the ice tray from an upper side and moved in an upper and lower direction, i.e., moved in an up and down direction, to manufacture ice pieces around the ice making member. When the ice pieces have reached to a predetermined size, the ice making member and the ice tray are separated from each other in the upper and lower direction. In this case, since the ice pieces are fixed to the ice making member, the ice making member and the ice pieces are separated from the ice tray. After that, the ice tray is moved to a position displaced from the underside of the ice making member and then the ice making member is heated. As a result, portions of the ice pieces fixed to the ice making member are melted, the ice pieces are dropped and stored in an ice storage part which is disposed on an under side.

The ice making device is described, for example, in Japanese Patent Laid-Open No. Hei 10-47824 and Japanese Patent Laid-Open No. 2004-301490. In the ice making devices, if water within the ice tray is completely frozen, the ice tray and ice pieces are in a fixed state and thus, when ice making members and the ice tray are to be separated from each other, the ice pieces may be left in the ice tray. Therefore, when ice pieces are to be manufactured around the ice making member, water within the ice tray is required not to be frozen completely.

However, in an ice making method in which water within the ice tray is not frozen completely, the size and shape of an ice piece cannot be determined by an inner peripheral face of the ice tray and thus it is difficult to obtain ice pieces having a desired size and shape. Further, since water within the ice tray is not frozen completely, the surface of a manufactured ice piece is in a wet state and thus water may be left in the ice storage part.

In order to prevent this problem, in a case that water within the ice tray is frozen completely, it is conceivable that the ice tray is heated with a heater to separate ice pieces from the ice tray and the ice making member is separated from the ice tray. However, when ice pieces within the ice tray are melted with the heater, the surface of the ice piece becomes a wet state and thus water may be stored within the ice storage part. Further, when a heater is provided, a manufacturing cost of the ice making device is increased.

SUMMARY

In view of the problems described above, at least an embodiment of the present invention may advantageously provide an ice making method in which an ice making member such as an evaporation pipe is inserted into an ice tray that stores water to manufacture an ice piece and manufactured ice pieces are stored in an optional ice storage part that is located on an under side of the ice tray and, in which the water within the ice tray is capable of being completely frozen and a heater for heating the ice tray is not provided. Further, at least an embodiment of the present invention may advantageously provide an ice making device for performing the ice making method.

According to at least an embodiment of the present invention, there may be provided an ice making method including an ice making member inserting step in which an ice making member is inserted into water for ice making that is stored in an ice tray, an ice piece making step in which the ice making member is cooled so that the water stored in the ice tray is frozen to form an ice piece or pieces, an ice making member heating step in which the ice making member is heated so that a portion of the ice piece sticking to the ice making member is melted, an ice making member drawing-out step in which the ice making member is drawn out from the ice pieces, an ice pieces separating step in which the ice tray is deformed to separate the ice pieces from the ice tray, and an ice pieces storing step in which the ice pieces having been separated is dropped from the ice tray to be stored in an ice storage part.

According to this embodiment of the present invention, when ice pieces formed in the ice tray are to be stored in the ice storage part, first, the ice making member is drawn out from the ice pieces so that the ice pieces are left in the ice tray. Therefore, the ice pieces and the ice tray may be allowed to be in a fixed state and thus the water stored in the ice tray is capable of being completely frozen by the ice making member. As a result, the shape of the ice pieces is determined by an inner peripheral face of the ice tray and thus an ice piece having a desired size and shape is manufactured. Further, since the surface of a manufactured ice piece or pieces is not in wet state, water is restrained to be stored in the ice storage part. In addition, since water within the ice tray is completely frozen, an ice making operation by the ice making member can be simply managed on the basis of time or the like. Further, the ice pieces which are left in the ice tray are dropped to the ice storage part when the ice tray is turned over and deformed and thus a heater for separating the ice piece or pieces from the ice tray is not required. Therefore, a manufacturing cost of the ice making device is restrained. In addition, since the surface of the ice piece or pieces is not melted by a heater, water is not stored in the ice storage part.

In accordance with an embodiment of the present invention, in the ice making member drawing-out step, the ice making member is drawn out upward from the ice pieces and the ice tray is moved relatively downward with respect to the ice making member and the ice pieces separating step. The ice pieces storing step is performed on the underside of the ice making member. According to this method, the size of the ice making device can be reduced in the horizontal direction when compared to the prior art.

In this case, in order to separate the ice pieces from the ice tray to drop the ice pieces into the ice storage part, it is preferable that, in the ice pieces separating step, a reversing operation in which the ice tray is reversed or turned over from an upward state to a downward state and a deforming operation in which the ice tray is deformed are performed in a parallel manner and, in the ice pieces storing step, the ice tray having been deformed is held in the downward state to drop the ice pieces into the ice storage part.

Specifically, it may be structured that guide plates in which guide grooves for guiding movement of the ice tray are respectively formed are provided on both sides of the ice tray, the guide grooves which are formed in the guide plates are respectively provided with a straight shaped guide groove portion that is extended in a straight line shape in the upper and lower direction and a curved guide groove portion that is continuously formed from a lower end of the straight shaped guide groove portion so as to be curved downward in a convex shape, and termination end portions of the curved guide groove portions in the guide plates are set to be at vertically offset positions each other. In this structure, it may be performed that, in the ice making member drawing-out step, an ice making member drawing-out operation is performed in which the ice making member is drawn out from the ice pieces when the ice tray is moved downward along the straight shaped guide groove portion and, in the ice pieces separating step, while performing the reversing operation where the ice tray is reversed from the upward state to the downward state when the ice tray is moved from the straight shaped guide groove portions along the curved guide groove portions, a deforming operation is performed in which the ice tray is twisted and deformed when the ice tray is moved along the termination end portions of the curved guide groove portions.

Further, it may be structured that guide plates in which guide grooves for guiding movement of the ice tray are respectively formed are provided on both sides of the ice tray, the guide grooves which are formed in the guide plates are respectively provided with a straight shaped guide groove portion that is extended in a straight line shape in the upper and lower direction and a curved guide groove portion that is continuously formed from a lower end of the straight shaped guide groove portion so as to be curved downward in a convex shape, and a pushing member is provided which is turnably supported around a turning center axial line and pressed against the ice tray for deforming the ice tray. In this structure, it may be performed that, in the ice making member drawing-out step, an ice making member drawing-out operation is performed in which the ice making member is drawn out from the ice pieces when the ice tray is moved downward along the straight shaped guide groove portion and, in the ice pieces separating step, a reversing operation is performed in which the ice tray is reversed from the upward state to the downward state when the ice tray is moved along the curved guide groove portions from the straight shaped guide groove portions, and a deforming operation in which the ice tray is deformed by the pushing member is performed when the ice tray is moved along the termination end portions of the curved guide groove portions.

In this case, it is preferable that two pins are provided in a separated manner on a side face portion of the ice tray, the ice making member drawing-out operation is performed when the two pins separated from each other are moved along the straight shaped guide groove portion which is provided in the guide plate, and the reversing operation and the deforming operation are performed when the two pins are moved along the curved guide groove portion.

Further, in order to drop the ice pieces to an under side of the ice tray, it is preferable that, in the reversing operation, the ice tray is reversed from the upward state where an upper face opening of the ice tray is located on an upper side with respect to a bottom of the ice tray to the downward state where the upper face opening of the ice tray is located on an under side with respect to the bottom of the ice tray and, in the deforming operation, the ice tray is deformed during the reversing operation from a vertical state where the upper face opening of the ice tray is in a vertical state to the downward state.

Further, in order to separate the ice pieces from the ice tray to drop the ice pieces into the ice storage part, it is preferable that, in the ice pieces separating step, a deforming operation is performed in which the ice tray in the upward state is deformed and, in the ice pieces storing step, a reversing operation is performed in which the ice tray is reversed from the upward state to the downward state.

Further, according to at least an embodiment of the present invention, there may be provided an ice making device including an ice tray which is provided with a plurality of storing parts for storing water for ice making, each of the plurality of the storing parts being formed of material which is capable of being elastically deformed, an ice storage part which is disposed on an under side of the ice tray, an ice making member which is inserted into the storing parts of the ice tray from an upper side for freezing water in the storing parts, an ice making member heating mechanism for heating the ice making member, an ice tray moving mechanism which performs an ice making member drawing-out operation in which the ice making member is drawn out from the storing parts, a reversing operation in which the ice tray is reversed from an upward state to a downward state, and a deforming operation in which the ice tray is deformed, when the ice tray is moved along a predetermined moving passage, guide plates disposed on both sides of the ice tray in which guide grooves for guiding movement of the ice tray are respectively formed, and the guide grooves which are provided in the guide plates with at least a straight shaped guide groove portion that is extended in a straight line shape in an upper and lower direction. The ice making member drawing-out operation is performed when the ice tray is moved along the straight shaped guide groove portion and the reversing operation and the deforming operation are performed on an under side with respect to the ice making member.

According to an embodiment of the present invention, the ice pieces which is left in the ice tray is separated from the ice tray to be dropped into the ice storage part when the ice tray is twisted and deformed while being turned over.

In this case, in order that the ice tray is twisted while being turned over, it may be structured that the guide groove which is formed in each of the guide plates is provided with a curved guide groove portion that is continuously formed from a lower end of the straight shaped guide groove portion so as to be curved downward in a convex shape, termination end portions of the curved guide groove portions of the guide plates are formed to be located at vertically offset positions each other, a reversing operation is performed in which the ice tray is turned over or reversed from an upward state to a downward state. The ice tray is moved along the curved guide groove portions from the straight shaped guide groove portions, and thus a deforming operation is performed in which the ice tray is twisted and deformed when the ice tray is moved along the termination end portions of the curved guide groove portions.

Further, in this case, in order that the ice tray is twisted while being turned over, it may be structured that two pins are provided in a separated manner on a side face portion of the ice tray, the ice making member drawing-out operation is performed when the two pins separated from each other are moved along the straight shaped guide groove portion which is provided in the guide plate, and the reversing operation and the deforming operation are performed when the two pins are moved along the curved guide groove portion.

Specifically, in order that the ice tray is twisted while being turned over, it may be structured that the ice tray moving mechanism includes a first drive pin which is attached to a first side face portion of the ice tray, a first guide pin which is attached to the first side face portion so as to be parallel to the first drive pin at a lower position with respect to the first drive pin, a second drive pin which is attached to a second side face portion of the ice tray so as to be located on the same axial line as an axial line of the first drive pin, a second guide pin which is attached to the second side face portion so as to be located on the same axial line as an axial line of the first guide pin, a first guide groove which is formed in a first side wall portion of a device case that faces the first side face portion and, into which the first drive pin and the first guide pin are slidably inserted, a second guide groove which is formed in a second side wall portion of the device case that faces the second side face portion and, into which the second drive pin and the second guide pin are slidably inserted, and a slide mechanism which makes the first drive pin and the second drive pin slide along the first guide groove and the second guide groove in a state that the first drive pin and the second drive pin are rotatably supported around their center axial lines. The first guide groove is formed with a first straight shaped guide groove portion, which is extended in an upper and lower direction in a straight line shape, and a first curved guide groove portion which is continuously formed from a lower end of the first straight shaped guide groove portion so as to be curved downward in a convex shape and the second guide groove is formed with a second straight shaped guide groove portion, which is extended in the upper and lower direction in a straight line shape, and a second curved guide groove portion which is continuously formed from a lower end of the second straight shaped guide groove portion so as to be curved downward in a convex shape. The first straight line-shaped portion and the second straight line-shaped portion are formed at the same position as each other when viewed in an axial direction of the first and the second drive pins and termination end portions of the first curved guide groove portion and the second curved guide groove portion are formed to be located at vertically offset positions each other when viewed in the axial direction of the first and the second drive pins. The ice making member drawing-out operation, the reversing operation of the ice tray turned around the first and the second drive pins, and the deforming operation in which the ice tray is twisted with the first and the second drive pins as centers are performed when the first and the second drive pins are moved along the first and the second guide grooves by the slide mechanism.

Further, in accordance with an embodiment of the present invention, in order that the ice tray is twisted while being turned over, it may be structured that a pushing member is provided which is turnably supported around a turning center axial line and, to which the plurality of the storing parts of the ice tray is pressed so that the plurality of the storing parts of the ice tray are deformed. The guide groove formed in each of the guide plates is provided with a curved guide groove portion that is continuously formed from a lower end of the straight shaped guide groove portion so as to be curved downward in a convex shape. A reversing operation is performed in which the ice tray is reversed from an upward state to a downward state when the ice tray is moved along the curved guide groove portion from the straight shaped guide groove portion, and a deforming operation is performed in which the plurality of the storing parts of the ice tray are pressed against the pushing member so that the plurality of the storing parts are deformed when the ice tray is moved along a termination end portion of the curved guide groove portion.

According to this embodiment of the present invention, the ice pieces which are left in the ice tray is separated from the ice tray to be dropped into the ice storage part when the ice tray is pressed against the pushing member to be deformed while being turned over.

In this case, it is preferable that two pins are provided in a separated manner on a side face portion of the ice tray, the ice making member drawing-out operation is performed when the two pins separated from each other are moved along the straight shaped guide groove portion which is provided in the guide plate, and the reversing operation and the deforming operation are performed when the two pins are moved along the curved guide groove portion.

Specifically, in order that the ice tray is pressed against the pushing member while being reversed, it may be structured that the ice tray moving mechanism includes a first drive pin which is attached to a first side face portion of the ice tray, a first guide pin which is attached to the first side face portion so as to be parallel to the first drive pin at a lower position with respect to the first drive pin, a second drive pin which is attached to a second side face portion of the ice tray so as to be located on the same axial line as an axial line of the first drive pin, a second guide pin which is attached to the second side face portion so as to be located on the same axial line as an axial line of the first guide pin, a first guide groove which is formed in a first side wall portion of a device case that faces the first side face portion and, into which the first drive pin and the first guide pin are slidably inserted, a second guide groove which is formed in a second side wall portion of the device case that faces the second side face portion and, into which the second drive pin and the second guide pin are slidably inserted, and a slide mechanism which makes the first drive pin and the second drive pin slide along the first guide groove and the second guide groove in a state that the first drive pin and the second drive pin are rotatably supported around their center axial lines. The first guide groove is formed with a first straight shaped guide groove portion, which is extended in an upper and lower direction in a straight line shape, and a first curved guide groove portion which is continuously formed from a lower end of the first straight shaped guide groove portion so as to be curved downward in a convex shape, and the second guide groove is formed with a second straight shaped guide groove portion, which is extended in the upper and lower direction in a straight line shape, and a second curved guide groove portion which is continuously formed from a lower end of the second straight shaped guide groove portion so as to be curved downward in a convex shape. The first guide groove and the second guide groove are formed at the same position as each other when viewed in an axial direction of the first and the second drive pins. The ice making member drawing-out operation, the reversing operation and the deforming operation of the ice tray with the first and the second drive pins as centers are performed when the first and the second drive pins are moved along the first and the second guide grooves by the slide mechanism. Further, the turning center axial line of the pushing member is set in parallel to the center axial line of the first and the second drive pins and the pushing member is turned around the turning center axial line while the ice tray is pressed against the pushing member.

Further, in accordance with an embodiment of the present invention, a pushing member is provided which is turnably supported around a turning center axial line and, to which the plurality of the storing parts of the ice tray is pressed so that the plurality of the storing parts of the ice tray is deformed.

The pushing member is turnably supported at a termination end position of the straight shaped guide groove portion and, in a state that the deforming operation has been performed in which the plurality of the storing parts of the ice tray are pressed against the pushing member to be deformed, the reversing operation is performed in which the ice tray having been pressed and deformed by the pushing member is reversed from an upward state to a downward state when the pushing member is turned.

According to the embodiment of the present invention, the ice pieces which are left in the ice tray are separated from the ice tray when the ice tray is pressed against the pushing member to be deformed and the ice pieces are dropped into the ice storage part when the ice tray is turned over.

In this case, in order that the ice tray is reversed after the ice tray has been pressed against the pushing member to be deformed, it is preferable that the ice tray moving mechanism includes a first drive pin which is attached to a first side face portion of the ice tray, a second drive pin which is attached to a second side face portion of the ice tray so as to be located on the same axial line as an axial line of the first drive pin, a first guide groove which is formed in a first side wall portion of a device case that faces the first side face portion so as to extend in an upper and lower direction in a straight line shape and, into which the first drive pin is slidably inserted, a second guide groove which is formed in a second side wall portion of the device case that faces the second side face portion so as to extend in the upper and lower direction in a straight line shape and, into which the second drive pin is slidably inserted, and a slide mechanism which makes the first drive pin and the second drive pin slide along the first guide groove and the second guide groove in a state that the first drive pin and the second drive pin are rotatably supported around their center axial lines. The first guide groove and the second guide groove are formed at the same position as each other when viewed in an axial direction of the first and the second drive pins. The ice making member drawing-out operation and the deforming operation of the ice tray are performed when the first and the second drive pins are moved along the first and the second guide grooves by the slide mechanism, the turning center axial line of the pushing member is set to coincide with the center axial line of the first and the second drive pins of the ice tray in a state that the ice tray has been pressed and deformed by the pushing member, and the ice tray reversing mechanism performs the reversing operation of the ice tray with the first and the second drive pins as centers when the pushing member is turned around the turning center axial line.

In accordance with an embodiment of the present invention, in order that the ice tray is pressed against the pushing member to be deformed, it is preferable that each of at least the plurality of the storing parts which structures the ice tray is formed of rubber material which is capable of being elastically deformed. Specifically, the rubber material may be formed of one of silicone rubber and fluororubber.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENTS

Ice making devices to which the present invention is applied will be described below with reference to the accompanying drawings.

[First Embodiment]

Figure 1:
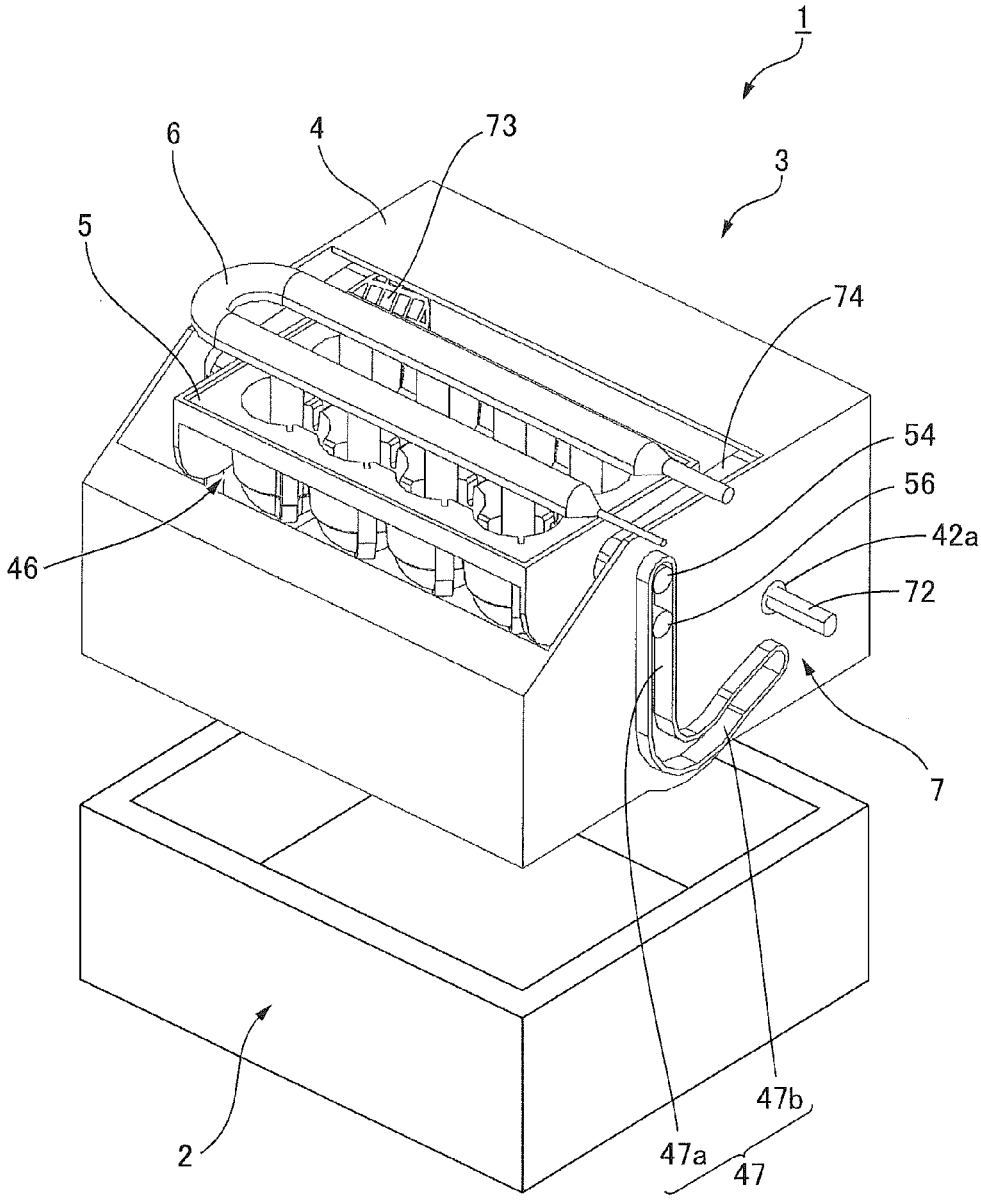
FIG. 1 is a perspective view showing an ice making unit of an ice making device in accordance with an embodiment of the present invention which is viewed from obliquely above.
Figure 2:
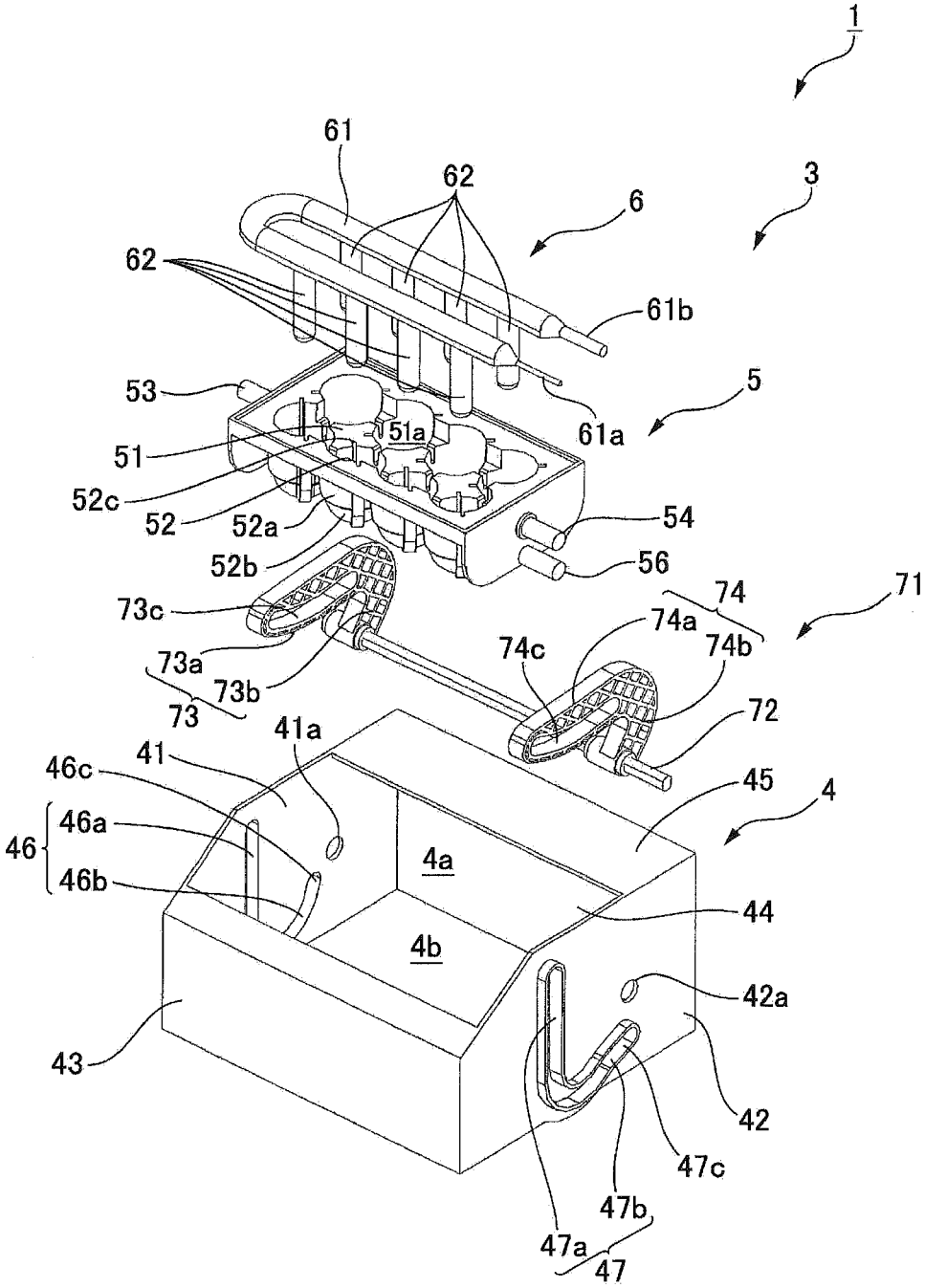
FIG. 2 is an exploded perspective view showing the ice making unit in FIG. 1.
Figure 3:
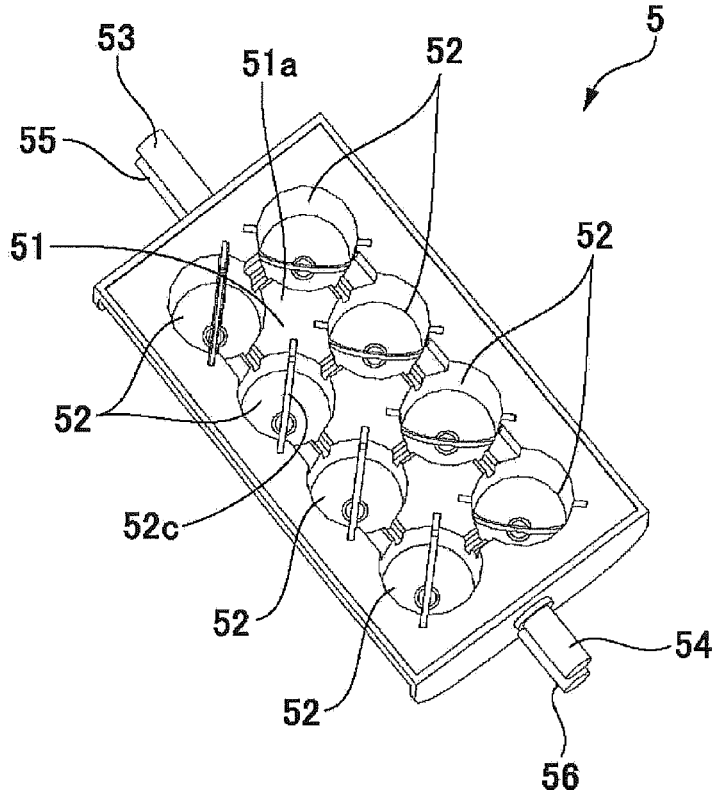
FIG. 3 is a perspective view showing an ice tray in FIG. 1.

FIG. 1 is a perspective view showing an ice making unit of an ice making device in accordance with an embodiment of the present invention which is viewed from obliquely above. FIG. 2 is an exploded perspective view showing the ice making unit in FIG. 1. FIG. 3 is a perspective view showing an ice tray.

Overall, an ice making device 1 successively manufactures ice pieces in a refrigerator or a freezer and drops manufactured ice pieces into an optional ice storage part 2 or ice bin which is disposed underneath the ice making unit 3. As shown in FIG. 1, the ice making device 1 includes an ice making unit 3 for manufacturing ice pieces and a drive unit (not shown) for driving the ice making unit 3. The optional ice storage part 2 is provided on an under side of the ice making unit 3. The drive unit is driven and controlled by a control section of a refrigerator or a freezer on or in which the ice making device 1 is mounted.

The ice making unit 3 includes a frame-shaped device case 4, an ice tray 5 which is disposed at a center portion on an inner side of the device case 4, an ice making member 6 that is inserted from an upper side into the ice tray 5 for freezing water for manufacturing ice pieces stored in the ice tray 5, an ice making member heating mechanism (not shown) for heating the ice making member 6, and an ice tray moving mechanism 7 which moves the ice tray 5 to a position separated from the ice making member 6 and deforms the ice tray 5 while the ice tray 5 is reversed to drop ice pieces manufactured in the ice tray 5 to the ice storage part 2 or bin below.

As shown in FIG. 2, the device case 4 is provided with right and left side plates 41 and 42 (first and second side wall portions), which define right and left ends of the ice making unit 3 in a widthwise direction, and a front plate 43 and a rear plate 44 which are stretched over front ends and rear ends of the right and left side plates 41 and 42. A top plate 45 is stretched over rear side portions of upper ends of the right and left side plates 41 and 42 and a top face opening 4*a* is formed on a front side of the top plate 45. The entire bottom area of the device case 4 is formed as an under face opening 4*b* (for the ice to fall through) as shown in FIG. 2.

The right and left side plates 41 and 42 are respectively formed with guide grooves 46 and 47 for providing with a function as a guide plate for moving the ice tray 5. The guide grooves 46 and 47 are provided with straight shaped guide groove portions 46*a* and 47*a*, which are extended in a straight line shape in an upper and lower direction, and curved guide groove portions 46*b* and 47*b* which are continuously formed from lower ends of the straight shaped guide groove portions 46*a* and 47*a* so as to be curved in a convex shape toward under side. When the ice making unit is viewed in its widthwise direction, a left side straight shaped guide groove portion (first straight shaped guide groove portion) 46*a* of the left side guide groove (first guide groove) 46 which is formed in the left side plate 41 and a right side straight shaped guide groove portion (second straight shaped guide groove portion) 47*a* of the right side guide groove (second guide groove) 47 which is formed in the right side plate 42 are provided so as to overlap with each other at the same position. Further, when the ice making unit is viewed in its widthwise direction, a left side curved guide groove portion (first curved guide groove portion) 46*b* of the left side guide groove 46 and a right side curved guide groove portion (second curved guide groove portion) 47*b* of the right side guide groove 47 are provided so that their termination end portions 46*c* and 47*c* are located at vertically offset positions each other. More specifically, the termination end portion 46*c* of the left side curved guide groove portion 46*b* is located at an upper position with respect to the termination end portion 47*c* of the right side curved guide groove portion 47*b*. The right and left guide grooves 46 and 47 structure parts of the ice tray moving mechanism 7.

When viewed from an upper side, the ice tray 5 is formed in a rectangular shape which is longer in the widthwise direction of the ice making unit. A recessed part 51 is formed in its center portion and the ice tray 5 is disposed so that an upper face opening 51*a* of the recessed part 51 is exposed from the top face opening 4*a* of the device case 4. The ice tray 5 is formed of resin which is elastically deformable material such as PPC and eight ice making cells (storing part) 52 which are capable of storing a certain amount of water are formed on a lower side portion of the recessed part 51. Eight ice making cells 52 are formed in two rows along the widthwise direction of the ice making unit and formed in four rows along the front and rear direction of the ice making unit. As shown in FIGS. 2 and 3, each of the ice making cells 52 is provided with a body part 52*a* in a tube-like shape and a hemispheric bottom part 52*b* which is bulged to an under side from the lower side of the body part 52*a*. An inner peripheral face of each of the ice making cells 52 is formed with a groove 52*c* which is extended in a direction intersecting with both of the widthwise direction and the front and rear direction of the ice making unit when viewed from the upper side.

In the ice making device 1 in this embodiment, since water in the ice tray 5 is cooled and frozen by the ice making member 6 which is inserted into the ice tray 5, the ice tray 5 is not required to be formed of material whose coefficient of thermal conductivity is high and thus a high degree of freedom in selecting material is attained. Therefore, the ice making cell (storing part) 52 which is formed in the lower portion of the recessed part 51 of the ice tray 5 may be formed of, but is not limited to, rubber material for example. For example, when the ice tray 5 is formed of silicone rubber or the like which is elastically deformed easily, the ice tray 5 is easily twisted to be deformed and thus ice pieces are easily separated from ice making cells (storing part) 52 of the ice tray 5. Alternatively, in a case that the ice tray 5 is formed of fluororubber or the like, when the ice tray 5 is deformed, ice pieces are easily separated from the ice making cells (storing part) 52 of the ice tray 5.

Two pins are provided in a separated manner on a side face portion of both sides of the ice tray 5. Specifically, a left side drive pin (first drive pin) 53 is protruded from a left side face portion in the widthwise direction of the ice making unit of the ice tray 5. A left side guide pin (first guide pin) 55 is protruded from a portion on the lower side of the left side drive pin 53 on the left side face of the ice tray 5 so as to be parallel to the left side drive pin 53. A right side drive pin (second drive pin) 54 is protruded from a right side face portion in the widthwise direction of the ice making unit of the ice tray 5 so as to be located on the same axial line as the left side drive pin 53. A right side guide pin (second guide pin) 56 is protruded from a portion on the lower side of the right side drive pin 54 on the right side face of the ice tray 5 so as to be located on the same axial line as the left side guide pin 55. The right and left drive pins 53 and 54 and the right and left guide pins 55 and 56 are protruded to outer sides from a center portion in a short side direction of the ice tray 5, in other words, from a portion between two rows of the ice making cells 52 which are extended in the widthwise direction of the ice making unit of the ice tray 5. The right and left drive pins 53 and 54 and the right and left guide pins 55 and 56 structure parts of the ice tray moving mechanism 7.

The ice making member 6 is an evaporation pipe which structures a refrigerating cycle together with a compressor, a condenser and the like (not shown). The ice making member 6 is provided with a U-shaped main pipe 61, which is disposed in parallel to the upper face opening 51*a* of the ice tray 5, and eight branch pipes 62 which are extended to the underside from the main pipe 61. Each of the branch pipes 62 is inserted into each of the ice making cells 52 from the upper side.

Refrigerant flowing in from a refrigerant inflow port 61*a* of the main pipe 61 is flowed through the main pipe 61 and the respective branch pipes 62 and then ejected from a refrigerant ejection port 61*b*. When refrigerant is flown in a state that water has been stored within the ice tray, heat exchange is performed between the refrigerant and the water within the ice making cells 52 through the branch pipes 62. As a result, water within the ice making cells 52 is frozen to be ice pieces. In accordance with an embodiment of the present invention, instead of providing the branch pipes 62, it may be structured that eight protruded parts formed of material whose heat conductivity is high are attached to the main pipe 61 and these protruded parts are inserted into the ice making cells 52 as the ice making member.

The ice making member heating mechanism supplies hot gas to the main pipe 61 and the branch pipes 62 of the ice making member 6 to heat the main pipe 61 and the branch pipes 62. Hot gas may be refrigerant which is pressurized to a high temperature or refrigerant which is heated by a heater to a high temperature. In accordance with an embodiment of the present invention, the ice making member heating mechanism may be structured so that a heater is disposed along the main pipe 61 and the heater is driven and controlled to heat the main pipe 61 and the branch pipes 62.

The ice tray moving mechanism 7 makes the ice tray 5 move along the right and left guide grooves 46 and 47 and performs a reversing operation in which the ice tray 5 is reversed from an upward state (upwardly directed state) to a downward state (downwardly directed state) and a deforming operation in which the ice tray 5 is twisted and deformed in a parallel manner to drop ice pieces of the ice tray 5 into the ice storage part 2. In the reversing operation, the ice tray 5 is reversed from the upward state where the upper face opening 51*a* is horizontally located at an upper position with respect to the bottom of the ice tray 5 to the downward state where the bottom of the ice tray 5 (lower end of the bottom part 52*b* of the ice making cell 52) is located at an upper position with respect to the upper face opening 51*a*. In the deforming operation, the ice tray 5 is twisted and deformed in the middle of the reversing operation from a state where the upper face opening 51*a* of the ice tray 5 is vertically located to a state where the ice tray 5 is reached to the downward state.

The ice tray moving mechanism 7 is provided with the right and left guide grooves 46 and 47, the right and left drive pins 53 and 54, the right and left guide pins 55 and 56, and a slide mechanism 71 which makes the right and left drive pins 53 and 54 move along the right and left guide grooves 46 and 47 in a state that the right and left drive pins 53 and 54 are rotatably supported around their center axis lines. The slide mechanism 71 is provided with a rotation shaft 72 which is stretched between the right and left side plates 41 and 42 on a rear side of the ice tray 5, and right and left turning arms 73 and 74 which are attached to the rotation shaft 72.

The rotation shaft 72 is extended in parallel to the center axis line of the left side drive pin 53 and the right side drive pin 54 of the ice tray 5 and both end portions of the rotation shaft 72 are inserted into right and left circular opening parts 41*a* and 42*a* which are formed in the right and left side plates 41 and 42 of the case 4 and thus the rotation shaft 72 is rotatably supported. A drive force is transmitted to the rotation shaft 72 from a drive source of the drive unit which is disposed on the outside of the ice making unit 3.

The right and left turning arms 73 and 74 are attached to the rotation shaft 72 so as to sandwich the ice tray 5 on both sides in the widthwise direction of the ice making unit. The left side turning arm 73 and the right side turning arm 74 are respectively provided with extended arm portions 73*a* and 74*a*, which are extended in the front and rear direction of the ice making unit, and curved arm portions 73*b* and 74*b* which are continuously curved downward from rear end portions of the extended arm portions 73*a* and 74*a*. End portions of the curved arm portions 73*b* and 74*b* are fixed to the rotation shaft 72 and the extended arm portions 73*a* and 74*a* are formed with slide grooves 73*c* and 74*c*.

The left side drive pin 53 of the ice tray 5 is slidably inserted into the left side guide groove 46 of the device case 4 in a state that the left side drive pin 53 is slidably inserted into the left side slide groove 73*c* of the left side turning arm 73. The right side drive pin 54 of the ice tray 5 is slidably inserted into the right side guide groove 47 of the device case 4 in a state that the right side drive pin 54 is slidably inserted into the right side slide groove 74*c* of the right side turning arm 74. Further, the right and left drive pins 53 and 54 are supported by the right and left turning arms 73 and 74 in a rotatable state around their center axis lines. The left side guide pin 55 of the ice tray 5 is slidably inserted into the left side guide groove 46 of the device case 4 and the right side guide pin 56 of the ice tray 5 is slidably inserted into the right side guide groove 47 of the device case 4.

When the rotation shaft 72 is rotationally driven in a predetermined angular range by the drive unit, the right and left turning arms 73 and 74 are integrally turned with the rotation shaft 72 in a predetermined angular range with the rotation shaft 72 as a center. With turning of the right and left turning arms 73 and 74, the right and left drive pins 53 and 54 are moved along the right and left guide grooves 46 and 47 while sliding on the right and left slide grooves 73*c* and 74*c*. Simultaneously, the right and left guide pins 55 and 56 are moved along the right and left guide grooves 46 and 47. As a result, the ice tray 5 is moved while being guided by the right and left guide grooves 46 and 47.

Figure 4:
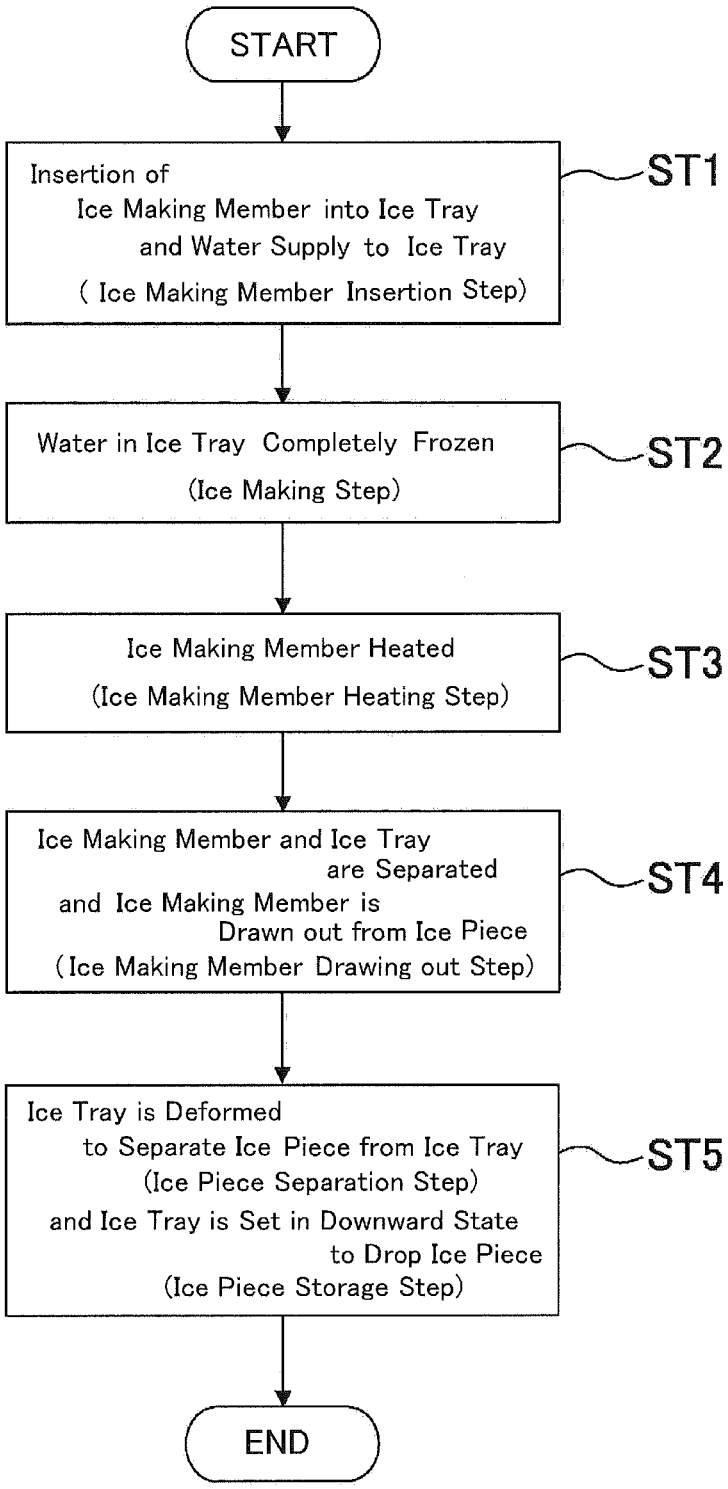
FIG. 4 is a flow chart showing an ice making operation in an ice making device in accordance with an embodiment of the present invention.
Figures 5A, 5B, 5C, 5D, 5E, 5F:
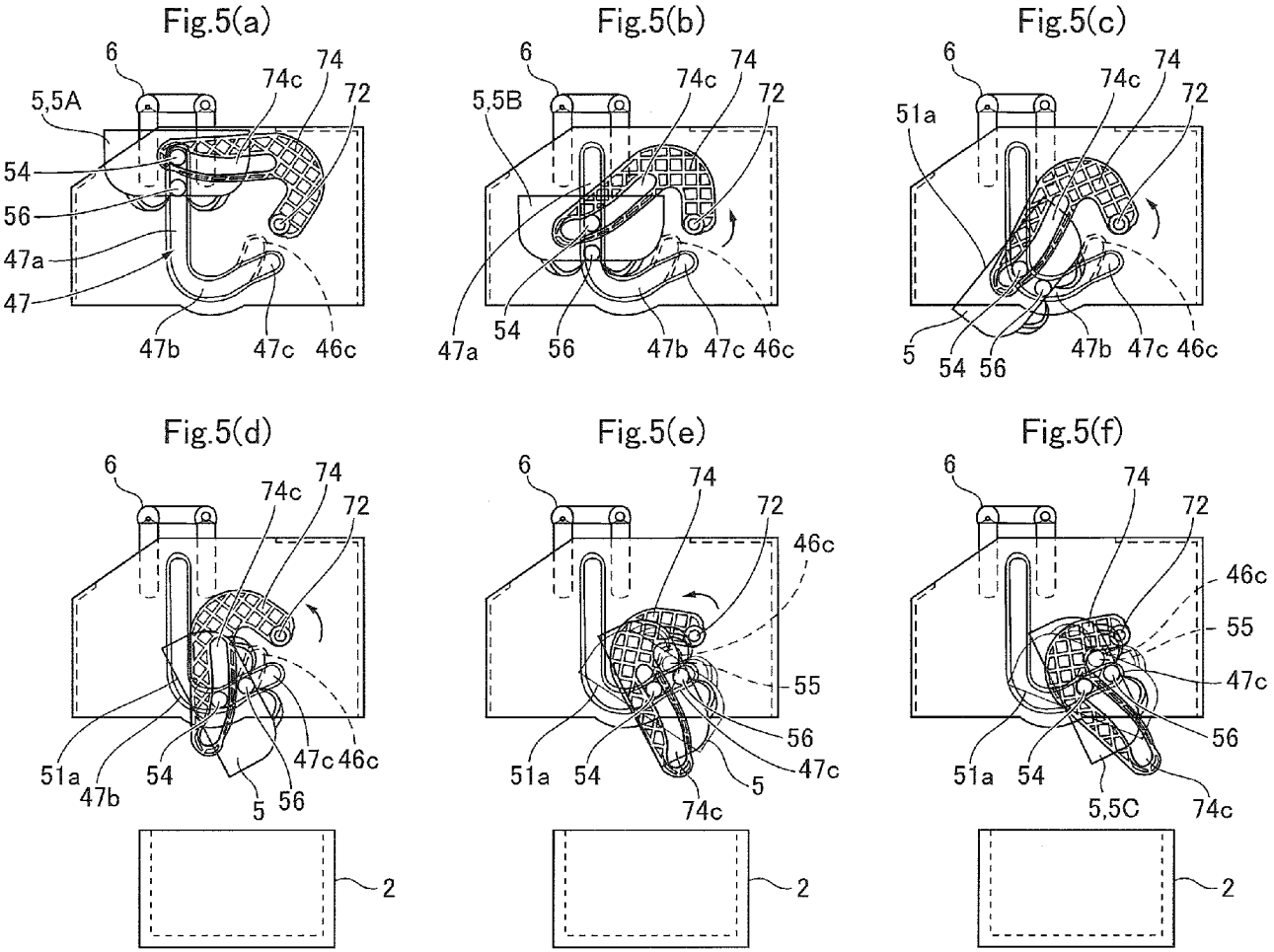
FIGS. 5(*a*) through 5(*f*) are explanatory views showing an ice storing operation in the ice making device shown in FIG. 1 where ice pieces are to be stored in an ice storage part from an ice tray.

Next, an ice making operation by the ice making device 1 will be described below with reference to FIG. 1, FIG. 4 and FIGS. 5(*a*) through 5(*f*). FIG. 4 is a flow chart showing an ice making operation. FIGS. 5(*a*) through 5(*f*) are explanatory views showing an ice storing operation in which ice pieces are to be stored in an ice storage part from an ice tray. In FIGS. 5(*a*) through 5(*f*), the ice tray 5 and the turning arms 74 are shown by a solid line so that movements of the ice tray and the turning arms are easily understood.

In an initial state before ice pieces are manufactured, as shown in FIG. 1 and FIG. 5(*a*)-5(*b*), the ice tray 5 is disposed at an insertion position 5A where the branch pipes 62 of the ice making member 6 are inserted into the ice making cells 52 from the upper side. In this state, a predetermined amount of water is supplied to the ice tray 5 through a water-supply pipe not shown. As a result, the ice making member 6 is in a state that the ice making member 6 is inserted into water which is stored in the ice making cells 52 (ice making member insertion step: step "ST1", FIG. 5(*a*)). In accordance with an embodiment of the present invention, it may be structured that, after a predetermined amount of water is supplied to the ice tray 5 through a water-supply pipe, the ice tray 5 and the ice making member 6 are relatively moved so that the branch pipes 62 of the ice making member 6 are inserted into the ice making cells 52 and, in this manner, the ice making member 6 is inserted into water stored in the ice making cell 52.

When the ice making cells 52 are filled with water, the control section flows refrigerant through the ice making member 6 and water in the ice making cells 52 is frozen through vaporization heat of the refrigerant (ice making step: step "ST2"). In this embodiment, water in the ice making cells 52 is completely frozen when a time period when the refrigerant is circulated is set to be a predetermined time period. Alternatively, water in the ice making cells 52 is completely frozen when the refrigerant is circulated until a temperature of the ice tray 5 is reached to a predetermined temperature. As a result, ice pieces in a fixed state to the ice tray 5 and to the ice making member 6 are manufactured within the ice making cell 52.

Next, the ice making member 6 is heated by the ice making member heating mechanism and portions of manufactured ice pieces sticking to the ice making member 6 are melted (ice making member heating step: step "ST3").

After that, the ice tray 5 is moved downward while the attitude of the ice tray 5 is maintained and the ice tray 5 is moved from the insertion position 5A to a first separated position 5B where the ice making member 6 is separated to the outside from the ice tray 5.

More specifically, the slide mechanism 71 makes the rotation shaft 72 turn in a counterclockwise direction and makes the turning arms 73 and 74 turn in the counterclockwise direction. As a result, the right and left drive pins 53 and 54 and the right and left guide pins 55 and 56 are moved downward along the straight shaped guide groove portions 46*a* and 47*a* of the right and left guide grooves 46 and 47 and thus, while the attitude of the ice tray 5 is maintained, the ice tray 5 is moved from the insertion position 5A to the first separated position 5B where the ice making member 6 is separated from the ice tray 5 to the outside. In this case, since ice pieces are in a fixed state to the ice tray 5, the ice pieces are moved down together with the ice tray 5. Therefore, the ice making member 6 is drawn out from the ice pieces (ice making member drawing out step: step "ST4", see FIG. 5(*b*)). In this embodiment, when the ice tray 5 is to be moved down, the ice pieces do not stick to the ice making member 6 and thus they are not in a fixed state. Therefore, a load is not applied to the ice making member 6.

After that, the ice tray 5 is deformed to separate ice pieces from the ice tray 5 and the ice tray 5 is directed to the underside to drop the ice pieces to the ice storage part 2 for storage (ice piece separation step and ice piece storage step: step "ST5", see FIG. 5(*c*) through FIG. 5(*f*)).

In this embodiment, in the step "ST5", the turning arms 73 and 74 are turned further in the counterclockwise direction to move the ice tray 5 along the curved guide groove portions 46*b* and 47*b*. During this operation, the ice tray 5 is twisted while the ice tray 5 is turned over in the downward state.

In other words, in the first separated position 5B, the right and left guide pins 55 and 56 of the ice tray 5 are located at lower ends of the straight shaped guide groove portions 46*a* and 47*a* of the right and left guide grooves 46 and 47. Therefore, when the turning arms 73 and 74 are further turned in the counterclockwise direction from this state, the right and left guide pins 55 and 56 begin to move along the curved guide groove portions 46*b* and 47*b* of the right and left guide grooves 46 and 47. As a result, the ice tray 5 is turned with the right and left drive pins 53 and 54 as centers and, as shown in FIG. 5(*c*), the upper face opening 51*a* of the ice tray 5 is inclined toward the front side and, after that, the upper face opening 51*a* is located in a vertical state.

When the turning arms 73 and 74 are further turned in the counterclockwise direction, as shown in FIG. 5(*d*), the right and left drive pins 53 and 54 are also slid on the curved guide groove portions 46*b* and 47*b* of the right and left guide grooves 46 and 47, and the ice tray 5 becomes to a state that its upper face opening 51*a* is directed to the underside.

After that, as shown in FIGS. 5(*e*) and 5(*f*), when the right and left guide pins 55 and 56 are moved along the termination end portions 46*c* and 47*c* of the right and left curved guide groove portions 46*b* and 47*b*, the ice tray 5 is twisted. In other words, the termination end portion 46*c* of the left side curved guide groove portion 46*b* and the termination end portion 47*c* of the right side curved guide groove portion 47*b* are vertically offset each other, i.e., their positions are different from each other in the upper and lower direction when viewed in the widthwise direction of the ice making unit and thus the ice tray 5 is twisted and deformed. As a result, as shown in FIG. 5(*f*), at the second separated position 5C where the right and left guide pins 55 and 56 have reached to the ends of the right and left curved guide groove portions 46*b* and 47*b*, ice pieces which are in a fixed state to the ice tray 5 are separated from the ice tray 5. Therefore, the ice pieces are dropped from the ice tray 5 which is directed to the underside and the ice pieces are stored in the optional ice storage part 2.

When the ice pieces in the ice tray 5 are stored in the ice storage part 2, the rotation shaft 72 is turned in the clockwise direction by the drive unit by a predetermined angular range. As a result, the turning arms 73 and 74 are turned in the clockwise direction by a predetermined angular range and the right and left drive pins 53 and 54 and the right and left guide pins 55 and 56 are moved along the guide grooves 46 and 47 in the opposite direction. Therefore, the twisting of the ice tray 5 is released and the ice tray 5 is returned to the insertion position 5A.

According to this embodiment, when ice pieces formed in the ice tray 5 are to be stored in the ice storage part 2, first, the ice making member 6 is drawn out from the ice pieces and the ice pieces are left in the ice tray 5 (step "ST4"). Therefore, the ice pieces and the ice tray 5 may be allowed to be in a fixed state and thus the water stored in the ice tray 5 is capable of being completely frozen by the ice making member 6. As a result, the shape of an ice piece is determined by a shape of an inner peripheral face of the ice making cell 52 of the ice tray 5 and thus ice pieces having a desired size and shape are manufactured. Further, since the surface of a manufactured ice piece is not in wet state, water is restrained from being stored in the ice storage part 2. In addition, since water within the ice tray 5 is completely frozen, an ice making operation by the ice making member 6 can be simply managed on the basis of time or the like. Further, ice pieces which are left in the ice tray 5 are dropped to the ice storage part 2 when the ice tray 5 is turned over and deformed and thus a heater for separating ice pieces from the ice tray 5 is not required. Therefore, a manufacturing cost of the ice making device 1 is not increased. In addition, since the surface of an ice piece is not melted by a heater, water is restrained from being stored in the ice storage part 2.

Further, in this embodiment, the ice making member 6 and the ice tray 5 are separated from each other in the upper and lower direction to separate the ice making member 6 from ice pieces and then, the ice tray 5 is deformed while reversed or turned over at the under position of the ice making member 6. Therefore, the size of the ice making device 1 can be restrained from increasing in the horizontal direction.

In addition, in this embodiment, when the rotation shaft 72 is rotationally driven to turn the turning arms 73 and 74, the ice tray 5 is twisted while being turned over downward. Therefore, since ice pieces are separated from the ice tray 5 and dropped into the ice storage part 2 or other arrangement or dispenser with a simple structure, a manufacturing cost of the ice making device 1 is not increased.

Further, in this embodiment, in the reversing operation where the ice tray 5 is reversed or turned over, the ice tray 5 is reversed from an upward state where the upper face opening 51*a* is located in a horizontal state at an upper position with respect to the bottom of the ice tray 5 to a downward state where the bottom of the ice tray 5 (lower ends of the bottom parts 52*b* of the ice making cells 52) is located on an upper position with respect to the upper face opening 51*a*. Further, in the deforming operation where the ice tray 5 is deformed, the ice tray 5 is deformed during a time after the upper face opening 51*a* of the ice tray 5 is reached to a vertical state to the downward state in the reversing operation. As a comparison example, for example, when the ice tray 5 is deformed before the upper face opening 51*a* of the ice tray 5 is reached to a vertical state in the reversing operation, ice pieces may be dropped to an obliquely front side from the ice tray 5 and collide with the device case 4 to cause to be cracked or to occur a collision noise. However, according to this embodiment, since ice pieces are dropped downward, cracking of the ice piece and occurrence of the collision noise are avoided.

In addition, according to this embodiment, the inner peripheral face of each of the ice making cells 52 is formed with the groove 52*c* which is extended in a direction intersecting with both of the widthwise direction of the ice making unit and the front and rear direction of the ice making unit and thus, when the ice tray 5 is twisted, the ice making cell 52 is easily widened and an ice piece is easily separated from the ice tray 5. Therefore, ice pieces are surely dropped from the ice tray 5.

In accordance with an embodiment of the present invention, the ice making cell 52 may be formed in a rectangular shape. Also in this case, when the groove 52*c* is formed on the inner peripheral face of each of the ice making cells 52, an ice piece is easily separated from the ice tray 5 when the ice tray 5 is twisted. Further, in the embodiment described above, the ice tray 5 is moved downward in order that the ice making member 6 is drawn out from ice pieces but the ice making member 6 may be moved upward.

[Second Embodiment]

Figure 6:
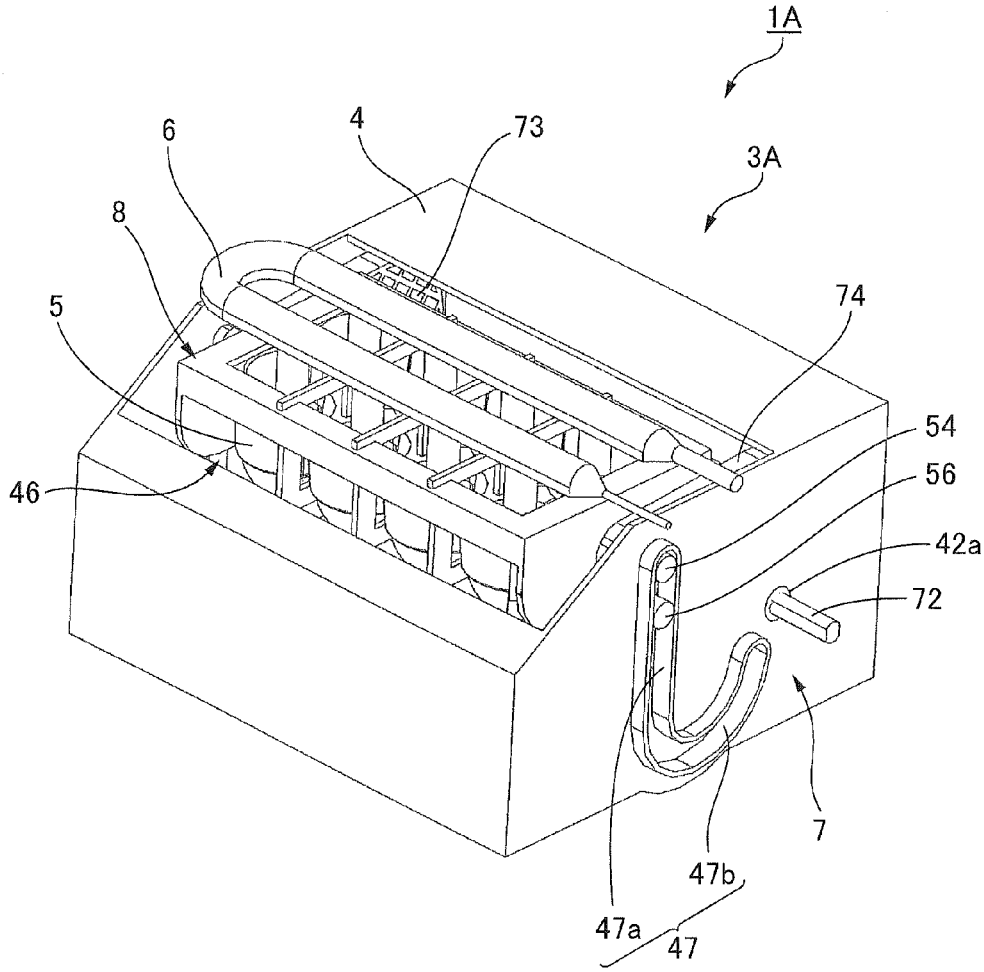
FIG. 6 is a perspective view showing an ice making unit of an ice making device in accordance with another embodiment of the present invention which is viewed from obliquely above.
Figure 7:
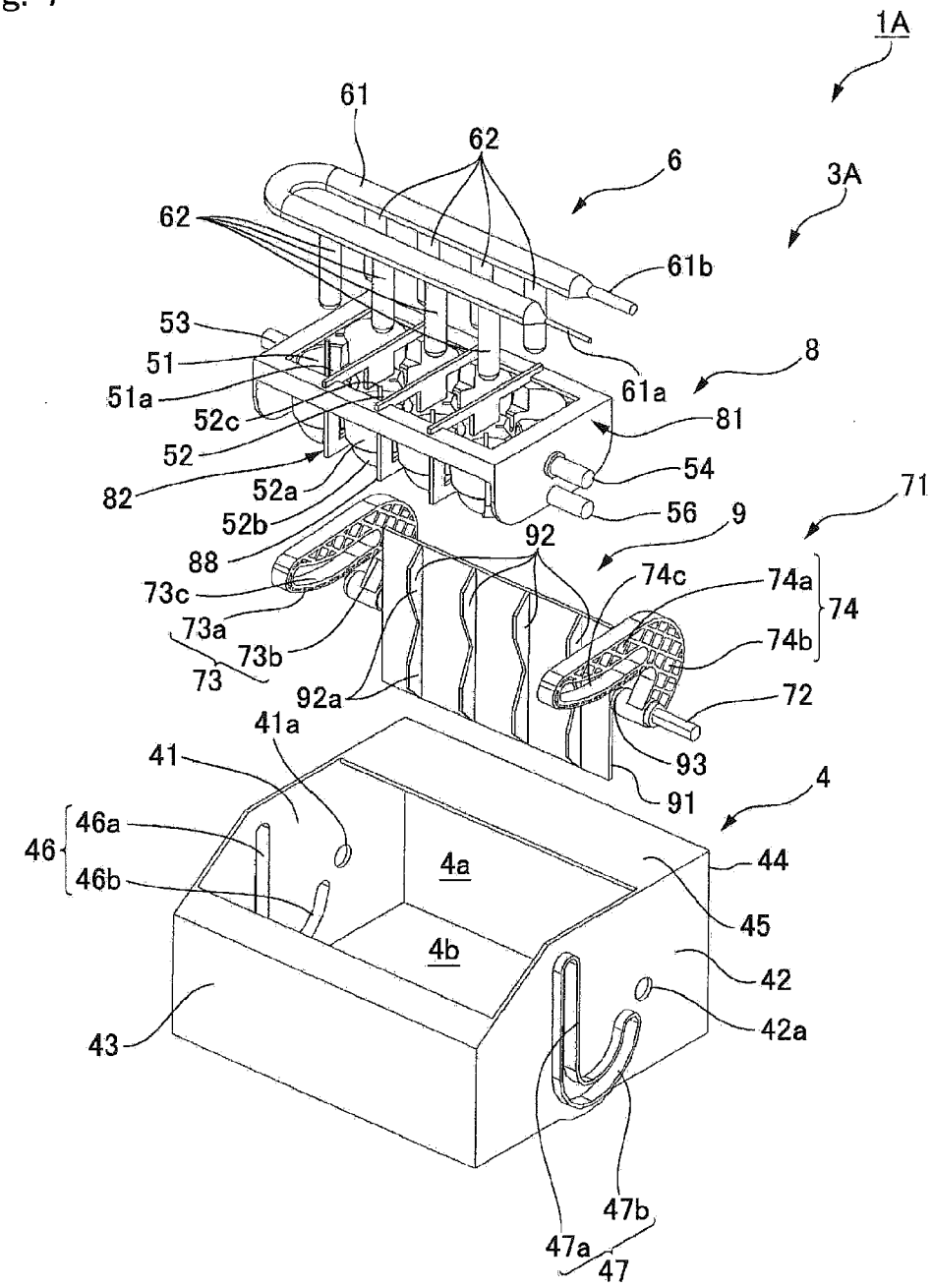
FIG. 7 is an exploded perspective view showing the ice making unit in FIG. 6.
Figure 8:
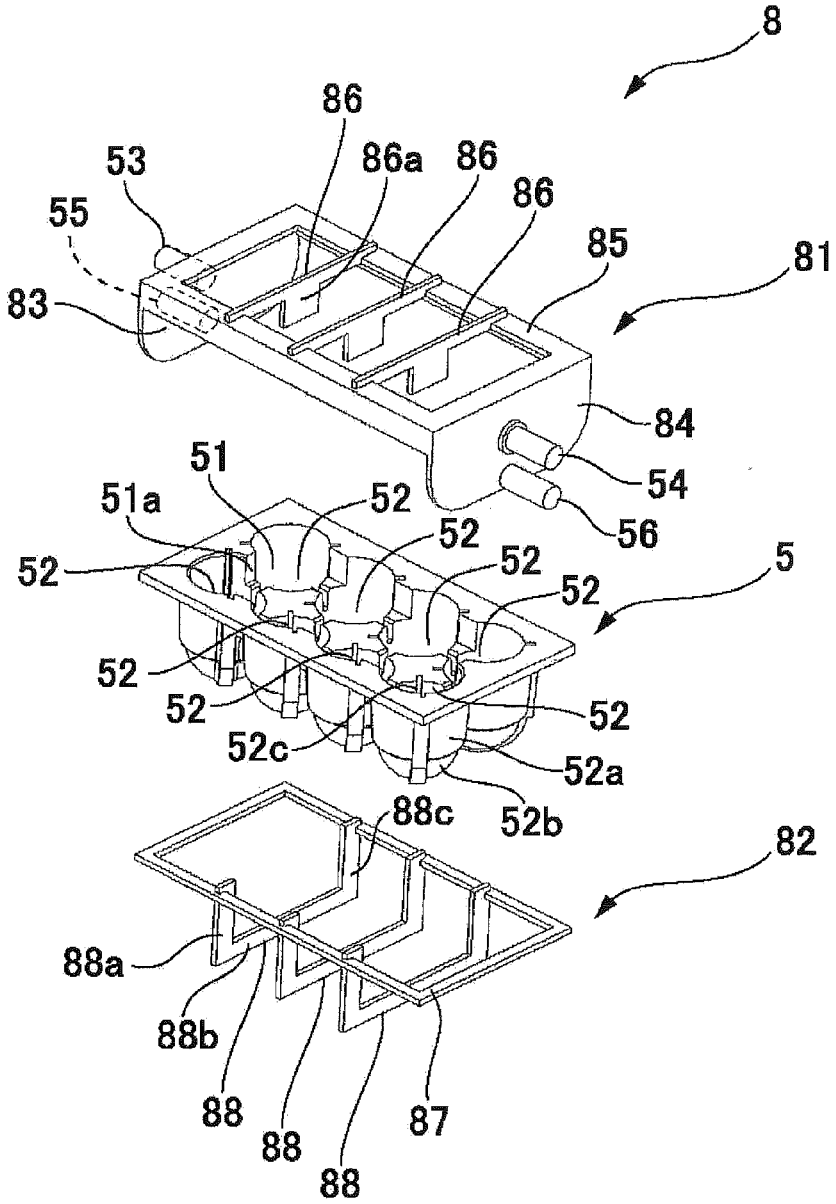
FIG. 8 is a perspective view showing an ice tray unit in FIG. 6.

FIG. 6 is a perspective view showing an ice making unit of an ice making device in accordance with a second embodiment of the present invention which is viewed from obliquely above. FIG. 7 is an exploded perspective view showing the ice making unit in FIG. 6. FIG. 8 is a perspective view showing the ice tray unit. The ice making device 1A in the second embodiment is provided with a structure corresponding to the above-mentioned ice making device 1 and thus the same reference signs are used for corresponding portions and their descriptions are omitted.

In an ice making unit 3A of the ice making device 1A in the second embodiment, the ice tray 5 is structured as a part of an ice tray unit 8. The right and left guide grooves 46 and 47 which structure the ice tray moving mechanism 7 are provided when viewed in the widthwise direction of the ice making unit so that the entire guide grooves 46 and 47 including the curved guide groove portions 46*b* and 47*b* are overlapped with each other at the same position.

Further, the ice making device 1A in this embodiment is provided with a pushing member 9 which is pressed against a bottom part 52*b* of the ice tray 5 so that the ice tray 5 is deformed. The ice tray moving mechanism 7 makes the ice tray 5 press against the pushing member 9 to deform while the ice tray 5 is reversed during a time when the ice tray 5 is moved from a separated position 5B to a separated position 5C. In other words, the ice tray moving mechanism 7 performs a reversing operation where the ice tray 5 is reversed from an upward state to a downward state and a deforming operation where the ice tray 5 is pressed against the pushing member 9 to be deformed in a parallel manner during a time when the ice tray 5 is moved from the first separated position 5B to the second separated position 5C. As a result, ice pieces in the ice tray 5 are dropped to the ice storage part 2. In the reversing operation, the ice tray 5 of the ice tray unit is reversed or turned over from an upward state where the upper face opening 51*a* is located at an upper position in a horizontal state with respect to the bottom of the ice tray 5 to a downward state where the bottom of the ice tray 5 is located at an upper position with respect to the upper face opening 51*a*. In the deforming operation, the ice tray 5 is pressed against the pushing member 9 to be deformed in the middle of the reversing operation after the upper face opening 51*a* of the ice tray 5 is reached to a vertical state until the ice tray 5 is reached to a downward state.

As shown in FIGS. 7 and 8, the ice tray unit 8 is provided with an ice tray 5 which is made of silicone rubber so as to be elastically deformable and an upper side support frame 81 and a lower side support frame 82 which sandwich the ice tray 5 from an upper and a lower directions. The upper side support frame 81 and the lower side support frame 82 prevent the ice tray 5 from being deformed by weight of water for ice making when water is stored within the ice tray 5.

The ice tray 5 is formed in a rectangular shape whose widthwise direction of the ice making unit is longer when viewed from an upper side. A recessed part 51 is formed in its center portion. A lower side portion of the recessed part 51 is formed with eight ice making cells (storing part) 52 in which a predetermined amount of water can be stored. Eight ice making cells 52 are formed in two rows along the widthwise direction of the ice making unit and in four rows along the front and rear direction of the ice making unit. As shown in FIGS. 7 and 8, each of the ice making cells 52 is provided with a body part 52*a* in a tube-like shape and a hemispheric bottom part 52*b* which is bulged to an under side from the lower side of the body part 52*a*. An inner peripheral face of each of the ice making cells 52 is formed with a groove 52*c* which is extended in a direction intersecting with both of the widthwise direction and the front and rear direction of the ice making unit when viewed from the upper side.

In this embodiment, also in the ice making device 1A, since water in the ice tray 5 is cooled and frozen by the ice making member 6 which is inserted into the ice tray 5, the ice tray 5 is not required to be formed of material having a high coefficient of thermal conductivity and thus a high degree of freedom in selecting material is attained. Therefore, for example, in a case that the ice tray 5 is formed of fluororubber or the like, when the ice tray 5 is deformed, ice pieces are easily separated from the ice tray 5.

The upper side support frame 81 is provided with right and left side plate portions 83 and 84, which cover both sides in the longitudinal direction of the ice tray 5, and an upper side rectangular frame portion 85 which is stretched over upper end edges of the right and left side plate portions 83 and 84. The upper side rectangular frame portion 85 is attached with three upper side support plates 86 which are extended in the front and rear direction of the ice making unit with a predetermined interval in the widthwise direction of the ice making unit. Each of the upper side support plates 86 is provided in its center portion with a protruded part 86*a* which is inserted into the recessed part 51 of the ice tray 5. A lower end of the protruded part 86*a* is abutted with a portion between two ice making cells 52 within the recessed part 51. The side plate portion 83 on the left side is attached with the left side drive pin 53 and the left side guide pin 55, and the side plate portion 84 on the right side is attached with the right side drive pin 54 and the right side guide pin 56. The right and left drive pins 53 and 54 and the right and left guide pins 55 and 56 are protruded from a center portion in the short side direction of the ice tray unit 8, in other words, protruded to outer sides from portions of the right and left side plate portions 83 and 84 which face portions between two rows of the ice making cells 52 extended in the widthwise direction of the ice making unit of the ice tray 5. The right and left drive pins 53 and 54 and the right and left guide pins 55 and 56 structure parts of the ice tray moving mechanism 7.

The lower side support frame 82 is provided with a lower side rectangular frame portion 87 which is abutted with an under face of the upper side rectangular frame portion 85. The lower side rectangular frame portion 87 is attached with three lower side support plates 88 in the widthwise direction of the ice making unit with a predetermined interval. Each of the lower side support plates 88 is provided with front and rear longitudinal plate portions 88*a*, which are extended in the upper and lower direction on both sides in the front and rear direction of the ice making unit of the ice tray 5, and a lateral plate portion 88*b* which is extended over the lower ends of the longitudinal plate portions 88*a*. The lateral plate portion 88*b* of each of the lower side support plates 88 is abutted with a portion between the bottom parts 52*b* of the ice making cells 52 which are juxtaposed in the widthwise direction of the ice making unit.

As shown in FIG. 7, the pushing member 9 is provided with a rectangular flat plate part 91 which is longer in the widthwise direction of the ice making unit and disposed on the rear side of the ice tray unit 8. A rectangular face of the flat plate part 91 is directed to the front and rear direction of the ice making unit and disposed in parallel with an extending direction of the right and left straight shaped guide groove portions 46*a* and 47*a* of the right and left guide grooves 46 and 47 of the device case 4. Four ribs 92 extending in the upper and lower direction are formed on the front face of the flat plate part 91. A rear face of the flat plate part 91 is formed with a tube part 93 extending in the widthwise direction of the ice making unit at its center portion in the upper and lower direction.

Four ribs 92 are provided in the widthwise direction of the ice making unit with a predetermined interval. Each rib 92 is provided with protruding portions 92*a* which are respectively protruded like a crest on its upper portion and its lower portion. These protruding portions 92*a* are respectively pressed by the bottom parts 52*b* of the respective ice making cells 52 of the ice tray 5 as described below. The rotation shaft 72 is inserted into the tube part 93 and the pushing member 9 is rotatably supported around the rotation shaft 72. In other words, the pushing member 9 is rotatably supported around a turning center axial line (rotation shaft 72) which is parallel to the center axial line of the left side drive pin 53 and the right side drive pin 54 of the ice tray 5.

In this embodiment, a distance between the rotation shaft 72, which is the turning center axial line of the pushing member 9, and the ice tray 5 is always set to be shorter than a dimension from the rotation shaft 72 to the upper end or the lower end of the flat plate part 91 of the pushing member 9 regardless of a moving position of the ice tray 5. As a result, when the pushing member 9 is turned, a part of the pushing member 9 is abutted with the ice tray 5 or the ice tray unit 8 and its turning range is restricted. Therefore, even when a restriction member for restricting a turning of the pushing member 9 is not provided separately, the pushing member 9 is prevented from being turned to a position where the face of the flat plate part 91 on which the ribs 92 are formed is directed to the rear side of the device.

Figures 9A, 9B, 9C, 9D, 9E:
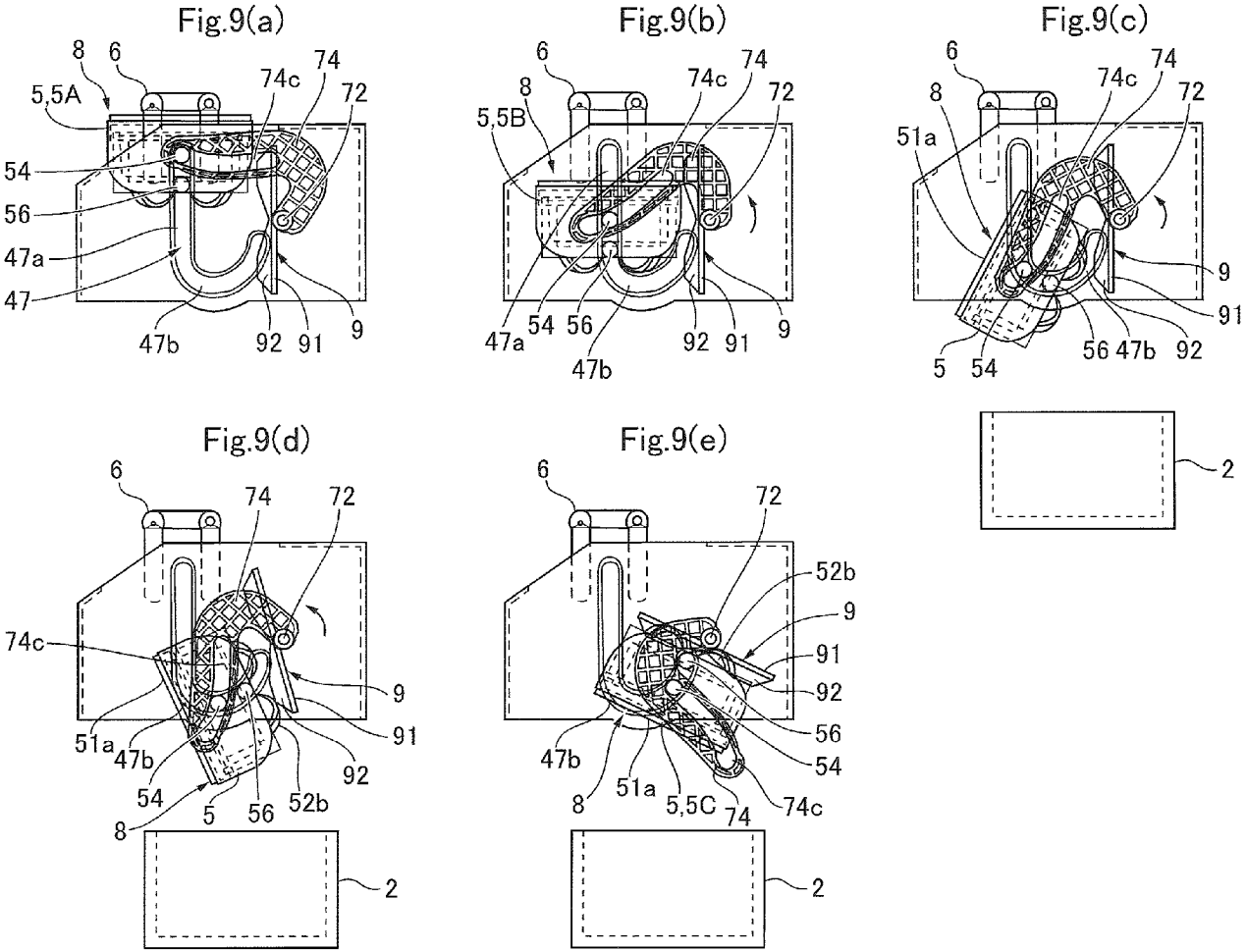
FIGS. 9(*a*) through 9(*e*) are explanatory views showing an ice storing operation in the ice making device shown in FIG. 6 where ice pieces are to be stored in an ice storage part from an ice tray.

FIGS. 9(*a*) through 9(*e*) are explanatory views showing an ice storing operation where ice pieces are to be stored in the ice storage part from the ice tray. In FIGS. 9(*a*) through 9(*e*), the ice tray 5, the turning arm 74 and the pushing member 9 are shown by the solid line so that movements of the ice tray, the turning arm and the pushing member are easily understood.

Also in the ice making device 1A in this embodiment, an ice making operation of the step "ST1" through the step "ST5" shown in FIG. 4 is performed. However, in the step "ST5" (ice piece separation step and ice piece storage step) in this embodiment, while the ice tray 5 is moved along the curved guide groove portions 46*b* and 47*b*, the ice tray 5 is reversed and pressed against the pushing member 9.

More specifically, the ice tray 5 is moved from the insertion position 5A shown in FIG. 9(*a*) to the first separated position 5B shown in FIG. 9(*b*) through the operation of the step "ST1" through the step "ST4". At the first separated position 5B, the right and left guide pins 55 and 56 of the ice tray unit 8 are located at lower ends of the straight shaped guide groove portions 46*a* and 47*a* of the right and left guide grooves 46 and 47.

In the step "ST5", when the turning arms 73 and 74 are further turned in the counterclockwise direction, the right and left guide pins 55 and 56 are moved along the curved guide groove portions 46*b* and 47*b* of the right and left guide grooves 46 and 47. As a result, the ice tray 5 is turned around the right and left drive pins 53 and 54 and, as shown in FIG. 9(*c*), the upper face opening 51*a* of the ice tray 5 is inclined toward the front side and then, the upper face opening 51*a* is reached to a vertical state.

Further, when the turning arms 73 and 74 are further turned, as shown in FIG. 9(*d*), the right and left drive pins 53 and 54 are also slid on the curved guide groove portions 46*b* and 47*b* of the right and left guide grooves 46 and 47 and then, the ice tray 5 is reached to a state where the upper face opening 51*a* is directed to the underside. Simultaneously, the ice tray 5 is moved to the rear side to approach the pushing member 9 and the bottom parts 52*b* are abutted with the protruding portions 92*a* of the ribs 92 of the pushing member 9.

After that, as shown in FIG. 5(*e*), during the ice tray 5 is reached to the second separated position 5C, the bottom parts 52*b* of the ice tray 5 are pressed against the pushing member 9 while the pushing member 9 is turned around the rotation shaft 72 so as to follow the turning-over operation of the ice tray 5. Therefore, the bottom parts 52*b* of the ice tray 5 formed of material such as silicone rubber or fluororubber which is elastically deformable are dented and deformed by the pushing member 9 and thus ice pieces in a fixing state to the ice tray 5 are separated from the ice tray 5 to be dropped into the ice storage part 2.

When the ice pieces of the ice tray 5 are stored in the ice storage part 2, the rotation shaft 72 is turned in the clockwise direction by the drive unit by a predetermined angular range. As a result, the turning arms 73 and 74 are turned in the clockwise direction by a predetermined angular range and the right and left drive pins 53 and 54 and the right and left guide pins 55 and 56 are moved along the guide grooves 46 and 47 in the opposite direction. Therefore, the ice tray 5 is separated from the pushing member 9 and the bottom parts 52*b* having been deformed are returned to their original shapes. Further, the ice tray 5 is returned to the insertion position 5A. Further, the ice tray 5 makes the pushing member 9 turn around the rotation shaft 72 so as to follow the returning operation of the ice tray 5 until the ice tray 5 is separated from the pushing member 9 and the pushing member 9 is returned to its original attitude.

Also in this embodiment, when ice pieces formed in the ice tray 5 are to be stored in the ice storage part 2, first, the ice making member 6 is drawn out from the ice pieces and the ice pieces are left in the ice tray 5 (step "ST4"). Therefore, the ice pieces and the ice tray 5 may be allowed to be in a fixed state to each other and thus water stored in the ice tray 5 is capable of being completely frozen by the ice making member 6. As a result, the shape of an ice piece is determined by a shape of an inner peripheral face of the ice making cell 52 of the ice tray 5 and thus ice pieces having a desired size and shape are manufactured. Further, since the surface of a manufactured ice piece is not in wet state, water is restrained from being stored in the ice storage part 2. In addition, since water within the ice tray 5 is capable of being completely frozen, an ice making operation by the ice making member 6 can be simply managed on the basis of time or the like. Further, ice pieces which are left in the ice tray 5 are dropped to the ice storage part 2 by when the ice tray 5 is turned over and deformed and thus a heater for separating ice pieces from the ice tray 5 is not required. Therefore, a manufacturing cost of the ice making device 1 is not increased. In addition, since the surface of an ice piece is not melted by a heater, water is restrained from being stored in the ice storage part 2.

Further, in this embodiment, the pushing member 9 is turnably supported around the turning center axial line which is parallel to the center axial line of the right and left drive pins 53 and 54 and, at the under position of the ice making member 6, the ice tray 5 is pressed against the pushing member 9 to be deformed while the pushing member 9 is turned so as to follow the turning-over operation of the ice tray 5. Therefore, the size of the ice making device 1A can be restrained from increasing in the horizontal direction.

In addition, in this embodiment, in the reversing operation where the ice tray 5 is reversed or turned over, the ice tray 5 is reversed from an upward state where the upper face opening 51*a* is located in a horizontal state at an upper position with respect to the bottom of the ice tray 5 to a downward state where the bottom of the ice tray 5 (lower ends of the bottom parts 52*b* of the ice making cells 52) is located on an upper position with respect to the upper face opening 51*a*. Further, in the deforming operation where the ice tray 5 is deformed, the ice tray 5 is deformed when the ice tray 5 is pressed against the pushing member 9 during a time after the upper face opening 51*a* of the ice tray 5 is reached to a vertical state to the downward state in the reversing operation. As a comparison example, for example, when the ice tray 5 is deformed before the upper face opening 51*a* of the ice tray 5 is reached to a vertical state in the reversing operation, ice pieces may be dropped to an obliquely front side from the ice tray 5 and collide with the device case 4 to be cracked or to occur a collision noise. However, according to this embodiment, since ice pieces are dropped downward, cracking of the ice piece and occurrence of the collision noise are avoided.

Further, in this embodiment, the ice tray 5 is formed of silicone rubber which is easily elastically deformed and the bottom part 52*b* of the ice making cell 52 is formed to be relatively thin. Therefore, when the ice tray 5 is pressed against the pushing member 9, the ice tray 5 is easily deformed and ice pieces are easily separated from the ice tray 5. As a result, ice pieces are surely dropped from the ice tray 5.

In addition, according to this embodiment, the inner peripheral face of each of the ice making cells 52 is formed with the groove 52*c* which is extended in a direction intersecting with both of the widthwise direction of the ice making unit and the front and rear direction of the ice making unit and thus, when the ice tray 5 is deformed, the ice making cell 52 is easily widened and an ice piece is easily separated from the ice tray 5. Therefore, ice pieces are surely dropped from the ice tray 5.

Further, according to this embodiment, when the rotation shaft 72 is rotationally driven to turn the turning arms 73 and 74, the ice tray 5 is deformed while being turned over downward. Therefore, since ice pieces are separated from the ice tray 5 and dropped into the ice storage part 2 with a simple structure, a manufacturing cost of the ice making device 1A is restrained.

Also in this embodiment, the ice making cell 52 may be formed in a rectangular shape. Also in this case, when a lower side portion of each of the ice making cells 52 is formed to be thin, the ice tray 5 is easily deformed. Further, when the groove 52*c* is formed on the inner peripheral face of each of the ice making cells 52, an ice piece is easily separated from the ice tray 5 when the ice tray 5 is deformed. Further, when the ice making member 6 is to be drawn out from ice pieces, the ice making member 6 may be moved upward.

[Third Embodiment]

Figure 10:
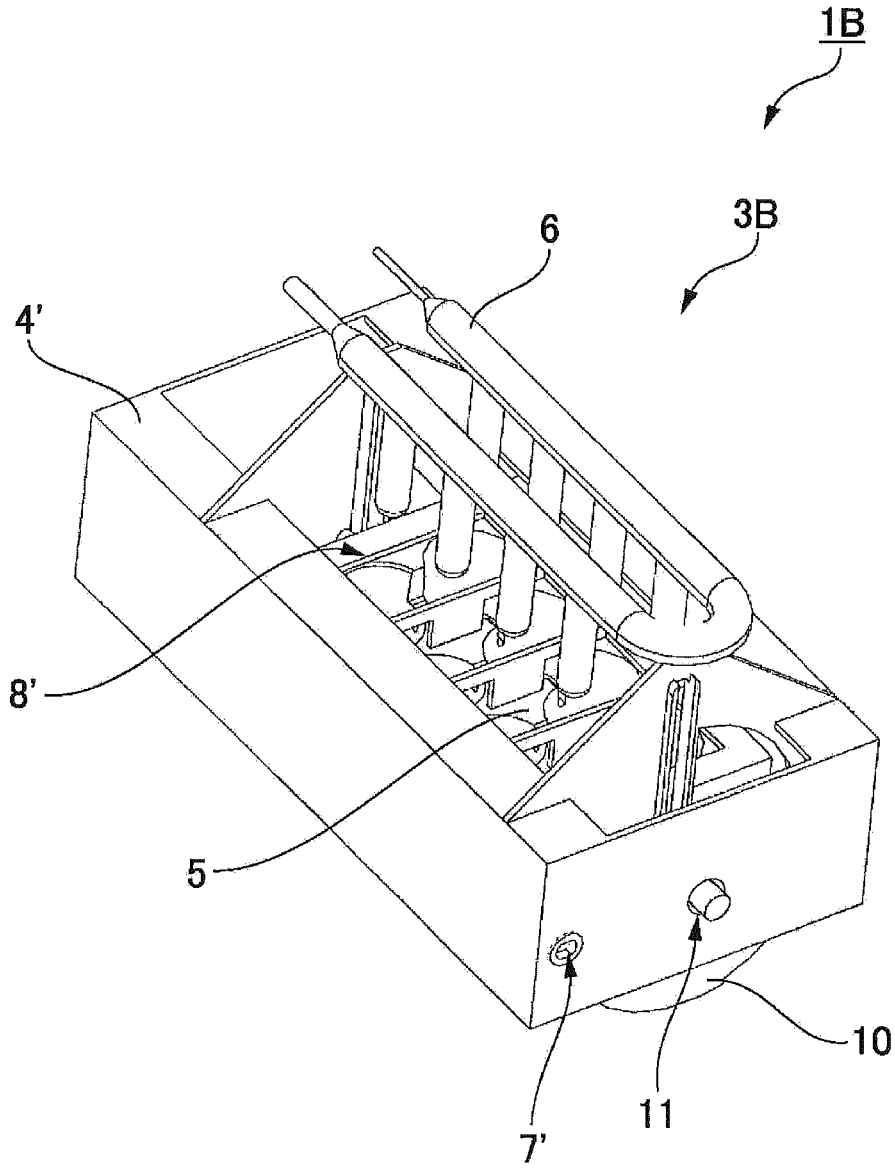
FIG. 10 is a perspective view showing an ice making unit of an ice making device in accordance with another embodiment of the present invention which is viewed from obliquely above.
Figure 11:
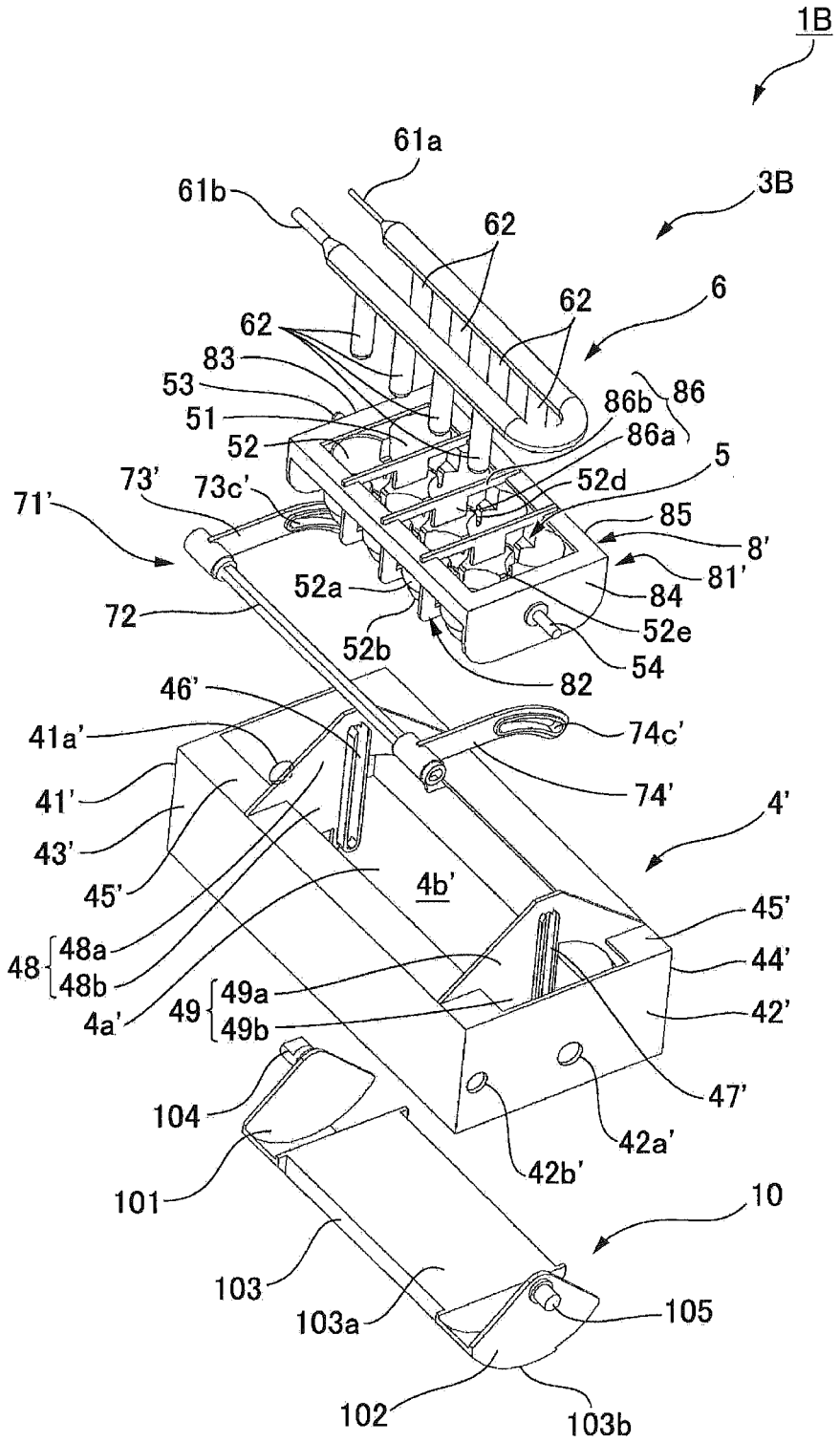
FIG. 11 is an exploded perspective view showing the ice making unit in FIG. 10.

FIG. 10 is a perspective view showing an ice making unit of an ice making device in accordance with a third embodiment of the present invention which is viewed from obliquely above. FIG. 11 is an exploded perspective view showing the ice making unit in FIG. 10. The ice making device 1B in the third embodiment is provided with a structure corresponding to the ice making devices 1 and 1A in the first and the second embodiments and thus the same reference signs are used for corresponding portions and their descriptions are omitted.

As shown in FIGS. 10 and 11, an ice making unit 3B of the ice making device 1B in the third embodiment includes a device case 4', an ice tray unit 8' which is disposed at a center portion on an inner side of the device case 4', an ice making member 6 for freezing water stored in the ice tray 5 in a state that the ice making member 6 is inserted into the ice tray 5 from an upper side, an ice making member heating mechanism (not shown) for heating the ice making member 6, and a pushing member 10 which is pressed against the bottom parts 52*b* of the ice tray 5 for deforming the ice tray 5. Further, the ice making unit 3B is provided with an ice tray moving mechanism 7', which makes the ice tray 5 move from an insertion position 5A where the ice making member 6 is inserted toward a second separated position 5C where the bottom parts 52*b* of the ice tray 5 are pressed against the pushing member 10 through a first separated position 5B where the ice making member 6 is drawn out from the ice tray 5, and an ice tray reversing mechanism 11 in which the ice tray 5 that is disposed at the second separated position 5C is reversed or turned over from an upward state to a downward state by turning of the pushing member 10.

As shown in FIG. 11, the device case 4' is provided with right and left side plates 41' and 42', which define right and left ends in a widthwise direction of the ice making unit, and a front plate 43' and a rear plate 44' which are stretched over front ends and rear ends of the right and left side plates 41' and 42'. Top plates 45' are stretched over front side portions and rear side portions of upper ends of the right and left side plates 41' and 42' and a portion between the front and the rear top plates 45' is formed as a top face opening 4*a*. An entire bottom face of the device case 4' is formed in an under face opening 4*b'*.

Two pieces of right and left guide plates (first and second side wall portions) 48 and 49 are stretched over the front plate 43' and the rear plate 44' in parallel with the right and left side plates 41' and 42'. The guide plates 48 and 49 are respectively provided with protruded plate portions 48*a* and 49*a* which are protruded from the front and the rear top plates 45' upward in a crest-like shape, and partitioning plate portions 48*b* and 49*b* which partition the front side portion of the inside of the device case 4'. Center portions of the respective guide plates 48 and 49 in the front and rear direction of the ice making unit are formed with guide grooves 46' and 47' which are extended in the upper and lower direction in a straight line shape from the protruded plate portions 48*a* and 49*a* to the partitioning plate portions 48*b* and 49*b*. The left side guide groove 46' which is formed in the left side guide plate 48 and the right side guide groove 47' which is formed in the right side guide plate 49 are formed to overlap with each other at the same position when viewed in the widthwise direction of the ice making unit. The right and left guide grooves 46' and 47' structure a part of the ice tray moving mechanism 7'.

The ice tray unit 8' is provided with an ice tray 5 which is made of silicone rubber that is capable of being easily elastically deformed and an upper side support frame 81' and a lower side support frame 82 which sandwich the ice tray 5 from an upper and a lower directions. The upper side support frame 81' and the lower side support frame 82 prevent the ice tray 5 from being deformed by weight of water for ice making when water is stored within the ice tray 5.

The ice tray 5 is formed in a rectangular shape whose widthwise direction of the ice making unit is longer when viewed from an upper side. A recessed part 51 is formed in its center portion. A lower side portion of the recessed part 51 is formed with eight ice making cells (storing part) 52 in which a predetermined amount of water can be stored. Eight ice making cells 52 are formed in two rows along the widthwise direction of the ice making unit and formed in four rows along the front and rear direction of the ice making unit. Each of the ice making cells 52 is provided with a body part 52*a* formed in a tube-like shape and a hemispheric bottom part 52*b* which is bulged to an under side from the lower side of the body part 52*a*. As shown in FIG. 11, an inner peripheral face of each of the ice making cells 52 is formed with a first groove 52*d* in communication with an adjacent ice making cell 52 in the widthwise direction of the ice making unit, and a second groove 52*e* in communication with an adjacent ice making cell 52 in the front and rear direction of the ice making cell 52.

Also in the ice making device 1B in this embodiment, since water within the ice tray 5 is cooled and frozen by the ice making member 6 which is inserted into the ice tray 5, the ice tray 5 is not required to be formed of material having a high coefficient of thermal conductivity and thus a high degree of freedom in selecting material is attained. Therefore, for example, in a case that the ice tray 5 is formed of fluororubber or the like, when the ice tray 5 is deformed, ice pieces are easily separated from the ice tray 5.

The upper side support frame 81' is provided with right and left side plate portions 83 and 84, which cover both sides in the longitudinal direction of the ice tray 5, and an upper side rectangular frame portion 85 which is stretched over upper end edges of the right and left side plate portions 83 and 84. The upper side rectangular frame portion 85 is attached with three upper side support plates 86 which are extended in the front and rear direction of the ice making unit with a predetermined interval in the widthwise direction of the ice making unit. Each of the upper side support plates 86 is provided in its center portion with a protruded part 86*a* which is inserted into the recessed part 51 of the ice tray 5. A lower end of the protruded part 86*a* is abutted with a portion between two ice making cells 52 within the recessed part 51. The side plate portion 83 on the left side is attached with the left side drive pin 53 and the side plate portion 84 on the right side is attached with the right side drive pin 54 on the same axial line as the left side drive pin 53. The right and left drive pins 53 and 54 are protruded from a center portion in the short side direction of the ice tray unit 8, in other words, the right and left drive pins 53 and 54 are protruded to outer sides from portions of the right and left side plate portions 83 and 84 which face portions between two rows of the ice making cells 52 extended in the widthwise direction of the ice making unit of the ice tray 5. The right and left drive pins 53 and 54 structure a part of the ice tray moving mechanism 7.

The lower side support frame 82 is provided with a structure similar to the lower side support frame 82 of the ice making unit 8 of the ice making device 1A. In other words, as shown in FIG. 8, the lower side support frame 82 is provided with a lower side rectangular frame portion 87 which is abutted with an under face of the upper side rectangular frame portion 85. The lower side rectangular frame portion 87 is attached with three lower side support plates 88 in the widthwise direction of the ice making unit with a predetermined interval. Each of the lower side support plates 88 is provided with front and rear longitudinal plate portions 88*a*, which are extended in the upper and lower direction on both sides in the front and rear direction of the ice making unit of the ice tray 5, and a lateral plate portion 88*b* which is extended over the lower ends of the longitudinal plate portions 88*a*. The lateral plate portion 88*b* of each of the lower side support plates 88 is abutted with a portion between the bottom parts 52*b* of the ice making cells 52 which are juxtaposed in the widthwise direction of the ice making unit.

The pushing member 10 is provided with right and left side plate portions 101 and 102 formed in a fan-like shape and a pushing member main body 103 which is stretched over lower edge portions in a circular arc shape of the right and left side plate portions 101 and 102. An upper end face of the pushing member main body 103 is formed to be a flat pushing face 103*a* to which the bottom parts 52*b* of the ice tray 5 is pressed and its lower end face is formed to be a circular arc face 103*b* which is protruded downward. The right and left side plate portions 101 and 102 are provided with pushing member drive pins 104 and 105 which are protruded to outer sides from pivot portions of the fan shape.

The pushing member 10 is inserted into the inside of the device case 4' from the lower side of the device case 4'. The left side plate portion 101 is disposed between the left side plate 41' of the device case 4' and the left side guide plate 48 and the right side plate portion 102 is disposed between the right side plate 42' of the device case 4' and the right side guide plate 49. The pushing member 10 is turnably supported when the right and left pushing member drive pins 104 and 105 are inserted into the right and left circular opening parts 41*a'* and 42*a'* which are formed in the right and left side plates 41' and 42' of the device case 4'. The right and left circular opening parts 41*a'* and 42*a'* are provided at positions overlapping with the lower end parts of the right and left guide grooves 46' and 47' when viewed in the widthwise direction of the ice making unit.

A driving force is transmitted to the left side pushing member drive pin 104 from a drive source of a drive unit which is disposed on the outside of the ice making unit 3. When a driving force is transmitted, the pushing member 10 is turned in a predetermined angular range with an axial line of the pushing member drive pins 104 and 105 as a turning center.

The ice tray moving mechanism 7' is provided with the right and left guide grooves 46' and 47', the right and left drive pins 53 and 54, and a slide mechanism 71' which makes the right and left drive pins 53 and 54 move along the right and left guide grooves 46' and 47'. The slide mechanism 71' is provided with a turning shaft 72, which is stretched between the right and left side plates 41' and 42' on a front side of the ice tray 5, and right and left turning arms 73' and 74' which are attached to the turning shaft 72.

The turning shaft 72 is extended in parallel to the axial line of the left side drive pin 53 and the right side drive pin 54 and turnably supported by when its both end portions are inserted into a circular opening part (not shown) formed in the left side plate 41' and a circular opening part 42*b'* formed in the right side plate 42'. A driving force is transmitted to the turning shaft 72 from a drive source of the drive unit which is disposed on the outside of the ice making unit 3.

The right and left turning arms 73' and 74' are attached to the turning shaft 72 so as to sandwich the ice tray 5 from both sides in the widthwise direction of the ice making unit. The left side turning arm 73' and the right side turning arm 74' are respectively extended in the front and rear direction of the ice making unit. Front end portions of the left side turning arm 73' and the right side turning arm 74' are fixed to the turning shaft 72 and their rear side portions are formed with slide grooves 73*c'* and 74*c'*.

The left side drive pin 53 of the ice tray unit 8' is slidably inserted into the left side guide groove 46' of the left side guide plate 48 in a state that the left side drive pin 53 is slidably inserted into the left side slide groove 73*c*' of the left side turning arm 73'. The right side drive pin 54 of the ice tray 5 is slidably inserted into the right side guide groove 47' of the right side guide plate 49 in a state that the right side drive pin 54 is slidably inserted into the right side slide groove 74*c*' of the right side turning arm 74'. Further, the right and left drive pins 53 and 54 are supported by the right and left turning arms 73' and 74' in a turnably state around their center axial lines.

When the turning shaft 72 is turnably driven in a predetermined angular range by the drive unit, the right and left turning arms 73' and 74' are integrally turned in a predetermined angular range with the turning shaft 72 as a center. With turning of the right and left turning arms 73' and 74', the right and left drive pins 53 and 54 are moved along the right and left guide grooves 46' and 47' while sliding on the slide grooves 73*c*' and 74*c*'. As a result, the ice tray 5 is moved along the right and left guide grooves 46' and 47'. In this embodiment, when the ice tray 5 is to be separated from the ice making member 6, the turning shaft 72 is turnably driven in the clockwise direction to turn the right and left turning arms 73' and 74' in the clockwise direction in a predetermined angular range.

In this embodiment, a dimension from the right and left drive pins 53 and 54 of the ice tray 5 to the lower ends of the bottom parts 52*b* is set to be longer than a dimension from the lower end parts of the guide grooves 46' and 47' to the pushing face 103*a* of the pushing member 10. Therefore, when the right and left drive pins 53 and 54 are reached to the lower end parts of the right and left guide grooves 46' and 47', the bottom parts 52*b* of the ice tray 5 are pressed against the pushing face 103*a* of the pushing member 10 and thus the bottom parts 52*b* of the ice tray 5 are deformed.

Figures 12A, 12B, 12C, 12D, 12E, 12F:
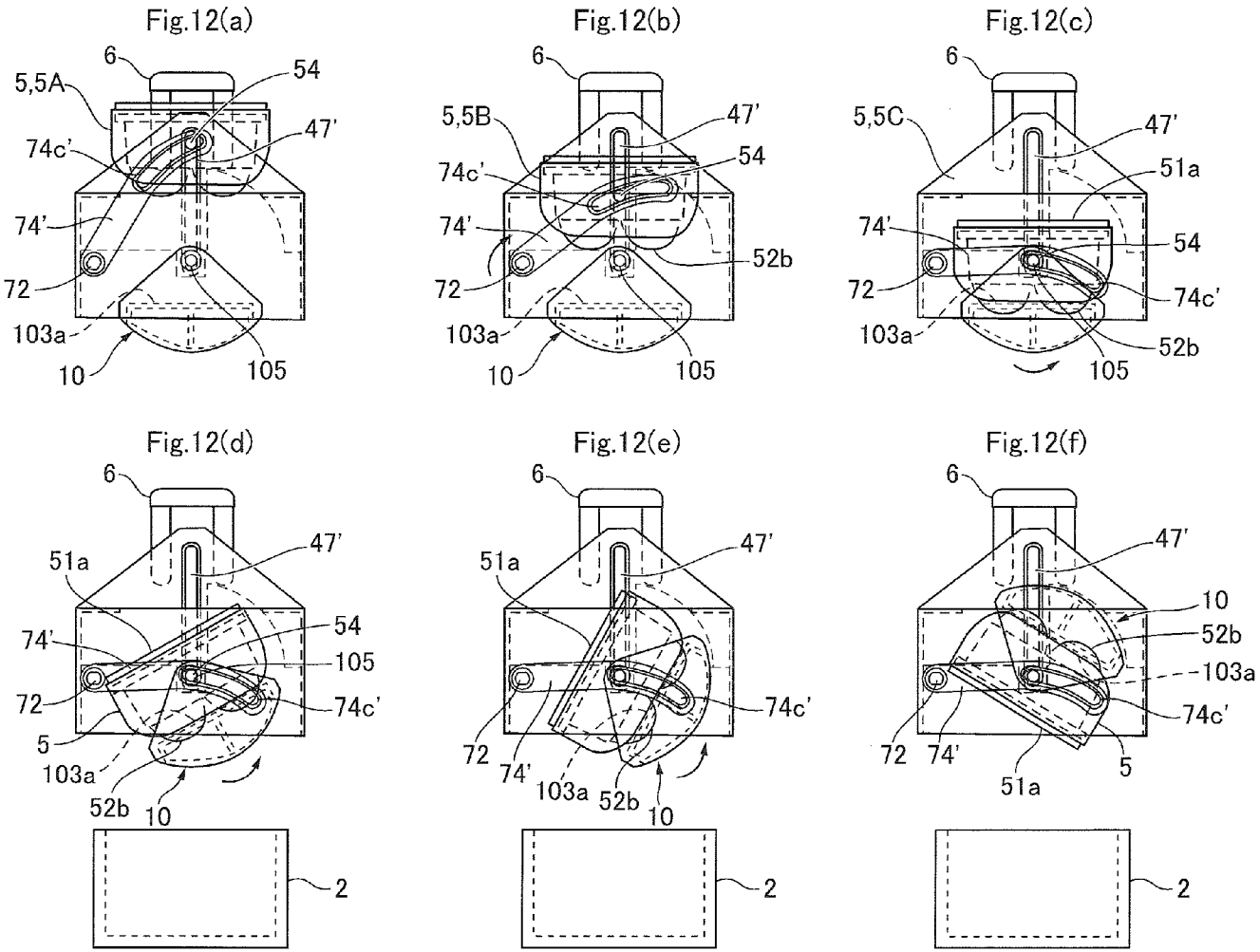
FIGS. 12(*a*) through 12(*f*) are explanatory views showing an ice storing operation in the ice making device shown in FIG. 10 where ice pieces are to be stored in an ice storage part from an ice tray.

Further, when the right and left drive pins 53 and 54 are reached to the lower end parts of the right and left guide grooves 46' and 47', the center axial lines of the right and left drive pins 53 and 54 of the ice tray 5 and the center axial lines (turning center axial line) of the pushing member drive pins 104 and 105 of the pushing member 10 are coincided with each other (see FIG. 12(*c*)). Therefore, in this state, the drive unit turns the pushing member drive pin 104 in a predetermined angular range, the ice tray 5 pressed against the pushing member 10 is turned with the right and left drive pins 53 and 54 as a center. In other words, the ice tray reversing mechanism 11 for reversing the ice tray 5 is structured by using the pushing member 10, the pushing member drive pins 104 and 105 for turning the pushing member 10, the circular opening parts 41*a* and 41*b* which turnably support the pushing member 10, and the like.

FIGS. 12(*a*) through 12(*f*) are explanatory views showing an ice storing operation where ice pieces are to be stored in an ice storage part from an ice tray. In FIGS. 12(*a*) through 12(*f*), the ice tray 5, the turning arm 74 and the pushing member 10 are shown by a solid line so that movement of the ice tray, the turning arm and the pushing member are easily understood.

Also in the ice making device 1B in this embodiment, the ice making operation of the step "ST1" through the step "ST5" shown in FIG. 4 is performed. However, in the step "ST5" (ice piece separation step and ice piece storage step), first, the ice tray 5 is deformed to separate ice pieces from the ice tray 5 and, after that, the ice tray 5 is turned over downward to drop the ice pieces into the ice storage part 2.

More specifically, the ice tray 5 is moved from the insertion position 5A shown in FIG. 12(*a*) to the first separated position 5B shown in FIG. 12(*b*) by the operation of the step "ST1" through the step "ST4". In the step "ST5", when the turning arms 73' and 74' are further turned in the clockwise direction, the ice tray 5 is moved down to the second separated position 5C where the right and left drive pins 53 and 54 are reached to the lower end parts of the right and left guide grooves 46' and 47'.

At the second separated position 5C, as shown in FIG. 12(*c*), the bottom parts 52*b* of the ice tray 5 are pressed against the pushing face 103*a* of the pushing member 10 and thus the bottom parts 52*b* of the ice tray 5 are deformed in a dented state. As a result, ice pieces are separated from the ice tray 5. Further, at the second separated position 5C, the center axial line of the right and left drive pins 53 and 54 of the ice tray 5 and the center axial line of the pushing member drive pins 104 and 105 of the pushing member 10 are coincided with each other. Therefore, when the pushing member 10 is turned by the ice tray reversing mechanism 11 in a predetermined angular range around the center axial line of the pushing member drive pins 104 and 105, as shown in FIG. 12(*d*) through FIG. 12(*f*), the ice tray 5 is turned around the center axial line of the right and left drive pins 53 and 54 and the ice tray 5 is reached to a state where the upper face opening 51*a* is directed downward. As a result, the ice pieces within the ice tray 5 are dropped into the ice storage part 2.

When the ice pieces of the ice tray 5 are stored in the ice storage part 2, the pushing member 10 is turned in a predetermined angular range in the reverse direction and the ice tray 5 is returned to a state where the upper face opening 51*a* is directed to an upper side. After that, the turning shaft 72 is turned by the drive unit in a predetermined angular range in the counterclockwise direction and the turning arms 73' and 74' are turned in a predetermined angular range in the counterclockwise direction. As a result, the right and left drive pins 53 and 54 are moved upward along the guide grooves 46' and 47' and thus the ice tray 5 is separated from the pushing member 10 and the deformed bottom parts 52*b* are returned to their original shapes. After that, the ice tray 5 is returned to the insertion position 5A.

Also in this embodiment, when ice pieces having been formed in the ice tray 5 are to be stored in the ice storage part 2, first, the ice making member 6 is drawn out from the ice pieces and the ice pieces are left in the ice tray 5 (step "ST4"). Therefore, the ice pieces and the ice tray 5 may be allowed to be in a fixed state and thus water stored in the ice tray 5 can be completely frozen by the ice making member 6. As a result, the shape of an ice piece is determined by a shape of an inner peripheral face of the ice making cell 52 of the ice tray 5 and thus ice pieces having a desired size and shape are manufactured. Further, since the surface of a manufactured ice piece is not in wet state, water is restrained from being stored in the ice storage part 2. In addition, since water within the ice tray 5 is completely frozen, an ice making operation by using the ice making member 6 can be simply managed on the basis of time or the like. Further, ice pieces which are manufactured within the ice tray 5 are dropped to the ice storage part 2 by when the ice tray 5 is deformed and turned over, a heater for separating ice pieces from the ice tray 5 is not required. Therefore, a manufacturing cost of the ice making device 1 is restrained. In addition, since the surface of an ice piece is not melted by a heater, water is restrained from being stored in the ice storage part 2.

Further, in this embodiment, the pushing member 10 is turnably supported and, at the directly under position of the ice making member 6, the pushing member 10 and the ice tray 5 are reversed or turned over to drop the ice pieces. In addition, the pushing member 10 and the ice tray 5 are turned around the axial line of the right and left drive pins 53 and 54 which are protruded to the outer sides from the center portions in the short side direction of the ice tray unit 8'. Therefore, the size of the ice making device 1B can be restrained from increasing in the horizontal direction.

Further, in this embodiment, the ice tray 5 is formed of silicone rubber which is easily elastically deformed and the bottom parts 52*b* of the ice making cells 52 are formed to be relatively thin. Therefore, when the ice tray 5 is pressed against the pushing member 9, the ice tray 5 is easily deformed and ice pieces are easily separated from the ice tray 5. As a result, ice pieces are surely dropped from the ice tray 5.

In addition, according to this embodiment, an inner peripheral face of each of the body parts 52*a* of the ice making cells 52 is formed with the first groove 52*d* and the second groove 52*e* with which each of the ice making cells 52 is made in communication with adjacent ice making cells 52 in the widthwise direction and the front and rear direction of the ice making unit. Therefore, when the ice tray 5 is deformed, the ice making cell 52 is easily widened and an ice piece is easily separated from the ice tray 5. Accordingly, ice pieces are surely dropped from the ice tray 5.

Also in this embodiment, the ice making cell 52 may be formed in a rectangular shape. Further, when the groove 52*c* is formed on the inner peripheral face of each of the ice making cells 52, an ice piece is easily separated from the ice tray 5 when the ice tray 5 is deformed. Further, when the ice making member 6 is to be drawn out from ice pieces, the ice making member 6 may be moved upward.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray comprising a plurality of storing parts for storing water, each of the plurality of the storing parts being formed of material which is elastically deformable;

an ice making member which is insertable into the storing parts of the ice tray from an upper side and structured to freeze the water in the storing parts;

an ice making member heating mechanism structured to heat the ice making member;

an ice tray moving mechanism structured to draw out the ice making member from the storing parts, reverse the ice tray from an upward state to a downward state, and deform the ice tray, when the ice tray is moved along a predetermined moving passage;

a pushing member turnably supported around a turning center axial line and to which the plurality of the storing parts of the ice tray is pressed for deforming the plurality of the storing parts of the ice tray, and guide plates disposed on both sides of the ice tray, the guide plates being formed with guide grooves for guiding movement of the ice tray, and the guide grooves having a straight shaped guide groove portion that is extended in a straight line shape in an upper and lower direction and a curved guide groove portion continuously formed from a lower end of the straight shaped guide groove portion so as to be curved downward in a convex state;

wherein the ice tray moving mechanism and guide grooves are configured such that the ice tray is drawn out when the ice tray is moved along the straight shaped guide groove portion, the ice tray is reversed from an upward state to a downward state when the ice tray is moved along the curved guide groove portion from the straight shaped guide groove portion, and each of the storing parts of the ice tray is pressed against the pushing member so that each of the storing parts are deformed when the ice tray is moved along a termination end portion of the curved guide groove portion.

2. The ice making device according to claim 1, wherein two pins are provided in a separated manner on a side face portion of the ice tray, the two pins are configured such that the ice making member is drawn out when the two pins separated from each other are moved along the straight shaped guide groove portion which is provided in the guide plate, and the two pins are configured such that the ice tray is reversed and each of the storing parts are deformed when the two pins are moved along the curved guide groove portion.

3. The ice making device according to claim 1, wherein the ice tray moving mechanism comprises:

a first drive pin which is attached to a first side face portion of the ice tray;

a first guide pin which is attached to the first side face portion so as to be parallel to the first drive pin at a lower position with respect to the first drive pin;

a second drive pin which is attached to a second side face portion of the ice tray so as to be located on a same axial line as an axial line of the first drive pin;

a second guide pin which is attached to the second side face portion so as to be located on a same axial line as an axial line of the first guide pin;

a first guide groove which is formed in a first side wall portion of a device case that faces the first side face portion and, into which the first drive pin and the first guide pin are slidably inserted;

a second guide groove which is formed in a second side wall portion of the device case that faces the second side face portion and, into which the second drive pin and the second guide pin are slidably inserted; and a slide mechanism structured to make the first drive pin and the second drive pin slide along the first guide groove and the second guide groove in a state that the first drive pin and the second drive pin are rotatably supported around their center axial lines;

the first guide groove is formed with a first straight shaped guide groove portion, which is extended in an upper and lower direction in a straight line shape, and a first curved guide groove portion which is continuously formed from a lower end of the first straight shaped guide groove portion so as to be curved downward in a convex state;

the second guide groove is formed with a second straight shaped guide groove portion, which is extended in the upper and lower direction in a straight line shape, and a second curved guide groove portion which is continuously formed from a lower end of the second straight shaped guide groove portion so as to be curved downward in a convex state;

the first straight line-shaped portion and the second straight line-shaped portion are formed at a same position as each other when viewed in an axial direction of the first and the second drive pins;

the first an second drive pins are configured such that the ice making member is drawn out, the ice tray is reversed and the ice tray is deformed with the first and the second drive pins as centers when the first and the second drive pins are moved along the first and the second guide grooves by the slide mechanism; and the turning center axial line of the pushing member is set in parallel to the center axial line of the first and the second drive pins, and the pushing member is turned around the turning center axial line while the ice tray is pressed against the pushing member.

4. An ice making device comprising:

an ice tray comprising a plurality of storing parts for storing water, each of the plurality of the storing parts being formed of material which is elastically deformable;

an ice making member which is insertable into the storing parts of the ice tray from an upper side and structured to freeze the water in the storing parts;

an ice making member heating mechanism structured to heat the ice making member;

an ice tray moving mechanism structured to draw out the ice making member from the storing parts, reverse the ice tray from an upward state to a downward state, and deform the ice tray, when the ice tray is moved along a predetermined moving passage;

a pushing member turnably supported around a turning center axial line and to which the plurality of the storing parts of the ice tray is pressed for deforming the plurality of the storing parts of the ice tray, and guide plates disposed on both sides of the ice tray, the guide plates being formed with guide grooves for guiding movement of the ice tray, and the guide grooves having a straight shaped guide groove portion that is extended in a straight line shape in an upper and lower direction, wherein the pushing member is turnably supported at a termination end position of the straight shaped guide groove portion, wherein the ice tray moving mechanism and guide grooves are configured such that the ice tray is drawn out when the ice tray is moved along the straight shaped guide move portion, and the ice tray is deformed at the termination end position of the straight shaped guide groove portion such that each of the storing parts of the ice tray is pressed against the pushing member so that each of the storing parts are deformed, and the ice tray having been pressed and deformed by the pushing member is reversed from an upward state to a downward state.

5. The ice making device according to claim 4, wherein the ice tray moving mechanism comprises:

a first drive pin which is attached to a first side face portion of the ice tray;

a second drive pin which is attached to a second side face portion of the ice tray so as to be located on a same axial line as an axial line of the first drive pin;

a first guide groove which is formed in a first side wall portion of a device case that faces the first side face portion so as to extend in an upper and lower direction in a straight line shape and, into which the first drive pin is slidably inserted;

a second guide groove which is formed in a second side wall portion of the device case that faces the second side face portion so as to extend in the upper and lower direction in a straight line shape and, into which the second drive pin is slidably inserted; and a slide mechanism structured to make the first drive pin and the second drive pin slide along the first guide groove and the second guide groove in a state that the first drive pin and the second drive pin are rotatably supported around their center axial lines;

the first guide groove and the second guide groove are formed at a same position as each other when viewed in an axial direction of the first and the second drive pins;

the first and second drive pins are configured such that the ice making member is drawn out and the ice tray is deformed when the first and the second drive pins are moved along the first and the second guide grooves by the slide mechanism;

the turning center axial line of the pushing member is set to coincide with the center axial line of the first and the second drive pins of the ice tray in a state that the ice tray has been pressed and deformed by the pushing member; and the ice tray reversing mechanism performs the reversing operation of the ice tray with the first and the second drive pins as centers when the pushing member is turned around the turning center axial line.

6. The ice making device according to claim 1, wherein each of at least the plurality of the storing parts which structures the ice tray is formed of rubber material which is capable of being elastically deformed.

7. The ice making device according to claim 6, wherein the rubber material is one of silicone rubber and fluororubber.

8. The ice making device according to claim 4, wherein each of at least the plurality of the storing parts which structures the ice tray is formed of rubber material which is capable of being elastically deformed.

9. The ice making device according to claim 6, wherein the rubber material is one of silicone rubber and fluororubber.

* * * * *